US011242188B2

(12) United States Patent
Davies et al.

(10) Patent No.: US 11,242,188 B2
(45) Date of Patent: Feb. 8, 2022

(54) STAND-UP POUCH WITH BREACHABLE SAUCE PACKET

(71) Applicant: United Source Packaging LLC, Vancouver, WA (US)

(72) Inventors: Edward Davies, Pleasanton, CA (US); Bradly Buchanan, Lopez Island, WA (US); David Fyfe, Novato, CA (US)

(73) Assignee: UNITED SOURCE PACKAGING LLC, Vancouver, WA (US)

( * ) Notice: Subject to any disclaimer, the term of this patent is extended or adjusted under 35 U.S.C. 154(b) by 3 days.

(21) Appl. No.: 15/681,645

(22) Filed: Aug. 21, 2017

(65) Prior Publication Data

US 2018/0057246 A1 Mar. 1, 2018

Related U.S. Application Data

(60) Provisional application No. 62/380,030, filed on Aug. 26, 2016.

(51) Int. Cl.

| | |
|---|---|
| ***B65D 81/34*** | (2006.01) |
| ***B65D 81/32*** | (2006.01) |
| ***B65D 75/00*** | (2006.01) |
| ***B65B 7/02*** | (2006.01) |
| ***B65B 61/20*** | (2006.01) |

(Continued)

(52) U.S. Cl.

CPC ..... *B65D 81/3461* (2013.01); *B65B 7/02* (2013.01); *B65B 25/22* (2013.01); *B65B 29/08* (2013.01); *B65B 51/146* (2013.01); *B65B 61/20* (2013.01); *B65D 75/008* (2013.01); *B65D 75/5855* (2013.01); *B65D 81/3261* (2013.01); *B65D 81/3272* (2013.01); *B65D 81/3453* (2013.01); *B65B 3/04* (2013.01); *B65D 2581/3427* (2013.01); *B65D 2581/3432* (2013.01)

(58) Field of Classification Search

CPC ..... B65D 81/3461; B65D 75/008; B65D 81/3261; B65D 81/3272; B65B 7/02; B65B 25/22; B65B 29/08; B65B 51/146; B65B 61/20

USPC ..... 426/114

See application file for complete search history.

(56) References Cited

U.S. PATENT DOCUMENTS 2,157,169 A * 5/1939 Foster ..... A47J 36/30 126/263.01
4,057,047 A * 11/1977 Gossett ..... F25D 5/02 126/263.07

(Continued)

FOREIGN PATENT DOCUMENTS

EP 0661219 A2 7/1995
JP 2000-085854 * 3/2000

OTHER PUBLICATIONS

Keogh M.K. (2006) Chemistry and Technology of Butter and Milk Fat Spreads. In: Fox P.F., McSweeney P.L.H. (eds) Advanced Dairy Chemistry vol. 2, p. 333 Lipids. Springer, Boston, MA.*

(Continued)

*Primary Examiner* — Viren A Thakur
*Assistant Examiner* — Chaim A Smith
(74) *Attorney, Agent, or Firm* — Silicon Edge Law Group LLP; Arthur J. Behiel

(57) ABSTRACT

Disclosed are disposable containers, such as a stand-up pouch, for heating food in a microwave oven and while automatically dispensing sauce onto the food. Methods and apparatuses for making sauce packets and disposable containers are also disclosed.

16 Claims, 23 Drawing Sheets

(51) Int. Cl.

| | |
|---|---|
| ***B65B 25/22*** | (2006.01) |
| ***B65B 51/14*** | (2006.01) |
| ***B65B 29/08*** | (2006.01) |
| ***B65D 75/58*** | (2006.01) |
| *B65B 3/04* | (2006.01) |

(56) References Cited

U.S. PATENT DOCUMENTS 4,291,085 A * 9/1981 Ito ..... B32B 27/00 428/215
4,596,713 A * 6/1986 Burdette ..... B65D 81/3272 206/219
6,030,652 A 2/2000 Hanus
9,114,913 B2 8/2015 Cole
2004/0226941 A1* 11/2004 Hopkins, Sr. ..... A23L 3/01 219/700
2005/0276885 A1 12/2005 Bennett
2006/0081134 A1* 4/2006 Ozawa ..... A47J 36/027 99/467
2006/0127549 A1* 6/2006 Murray ..... B65D 75/5827 426/393
2006/0196784 A1* 9/2006 Murray ..... B65B 43/465 206/219
2007/0071855 A1* 3/2007 Kanzaki ..... B65D 81/3453 426/107
2009/0035424 A1* 2/2009 Mita ..... B32B 27/08 426/113
2009/0175563 A1 7/2009 Weaver
2011/0308977 A1* 12/2011 DiLiberto ..... B65D 81/3272 206/222
2014/0366484 A1* 12/2014 Galbasini ..... B65D 75/008 53/410

OTHER PUBLICATIONS

Sakai et al., JP 2000-085854 Machine Translation, Mar. 2000.*
Ed Davies, Packaging Primer Section 7—Packaging Machines (Fundamentals in Flexible Packaging), Crown Technologies 2004, 30 pages.
Packaging World, Woolies Debuts Novel Ovenable Bags, Food Stuff SA, Sep. 19, 2013, 3 pages.
Sara Greasley, Stand Up Pouch Styles, downloaded from http://howtobuypackaging.com/standuppouchstyles/, May 26, 2015, 5 pages.
Sirane Ltd, Thinking Packaging, Seafood Global 2015 Special, 32 pages.
Wikipedia, Vertical form fill sealing machine, downloaded Aug. 9, 2016 from https://en.wikipedia.org/wiki/Vertical_form_fill_sealing_machine, 3 pages.
Zhang, Stand Up Pouch—How to pick a Bottom Gusset, downloaded from http://www.weijiazhang.com/2014/01/16/stand-up-pouch-how-to-pick-a-bottom-gusset/, Jan. 16, 2014, 2 pages.

* cited by examiner

900

1100

1300

| Trial # | Sauce Volume | % Water | % Butter | Pouch Height (Inches) | g Broccoli | Rupture, Seconds |
|---|---|---|---|---|---|---|
| 1 | 0.25 | 100% | 0% | 1.5 | 1.5 | 30 |
| 2 | 0.25 | 100% | 0% | 1.5 | 350 | 280 |
| 3 | 0.25 | 30% | 70% | 1.25 | 360 | 51 |
| 4 | 0.25 | 30% | 70% | 1.25 | 170 | 51 |
| 5 | 0.5 | 30% | 70% | 1.75 | 360 | 40 |
| 6 | 0.25 | 30% | 70% | 2 | 173 | 54 |
| 7 | 0.5 | 10% | 90% | 1.75 | 170 | 30 |
| 8 | 0.25 | 50% | 50% | 1.75 | 170 | 45 |
| 9 | 0.25 | 0% | 100% | 1.5 | 350 | None |

FIG. 13

STAND-UP POUCH WITH BREACHABLE SAUCE PACKET

FIELD

The present invention relates generally to a disposable container for heating food and dispensing sauce onto the food in a microwave oven, and methods and apparatuses for making the disposable container.

BRIEF DESCRIPTION OF THE DRAWINGS

The subject matter presented herein is illustrated by way of example, and not by way of limitation, in the figures of the accompanying drawings and in which like reference numerals refer to similar elements and in which:

FIG. 13 depicts a table 1300 showing experimental results of various combinations of liquid compositions and parameters.

DETAILED DESCRIPTION

A disposable container for heating food automatically dispenses sauce from an internal, thermally breachable sauce packet onto the food during a heating interval. The packet is attached to an interior sidewall of the disposable container, above a food region containing the food. During heating, for example in a microwave oven, the sauce heats and expands. When the pressure from the expanding sauce reaches a breach threshold, the packet breaches open, releasing the sauce down onto the food. The food and sauce, now comingled, continue heating until the end of the heating interval.

The breach threshold is advantageously adjustable to release the sauce at times appropriate for various foods. For example, a breach threshold may be adjusted to occur 30-60 seconds into the heating interval for vegetables such as broccoli or asparagus, and may be adjusted to occur, e.g., two minutes into the heating interval for denser foods such as potatoes or meat.

Figure 1:
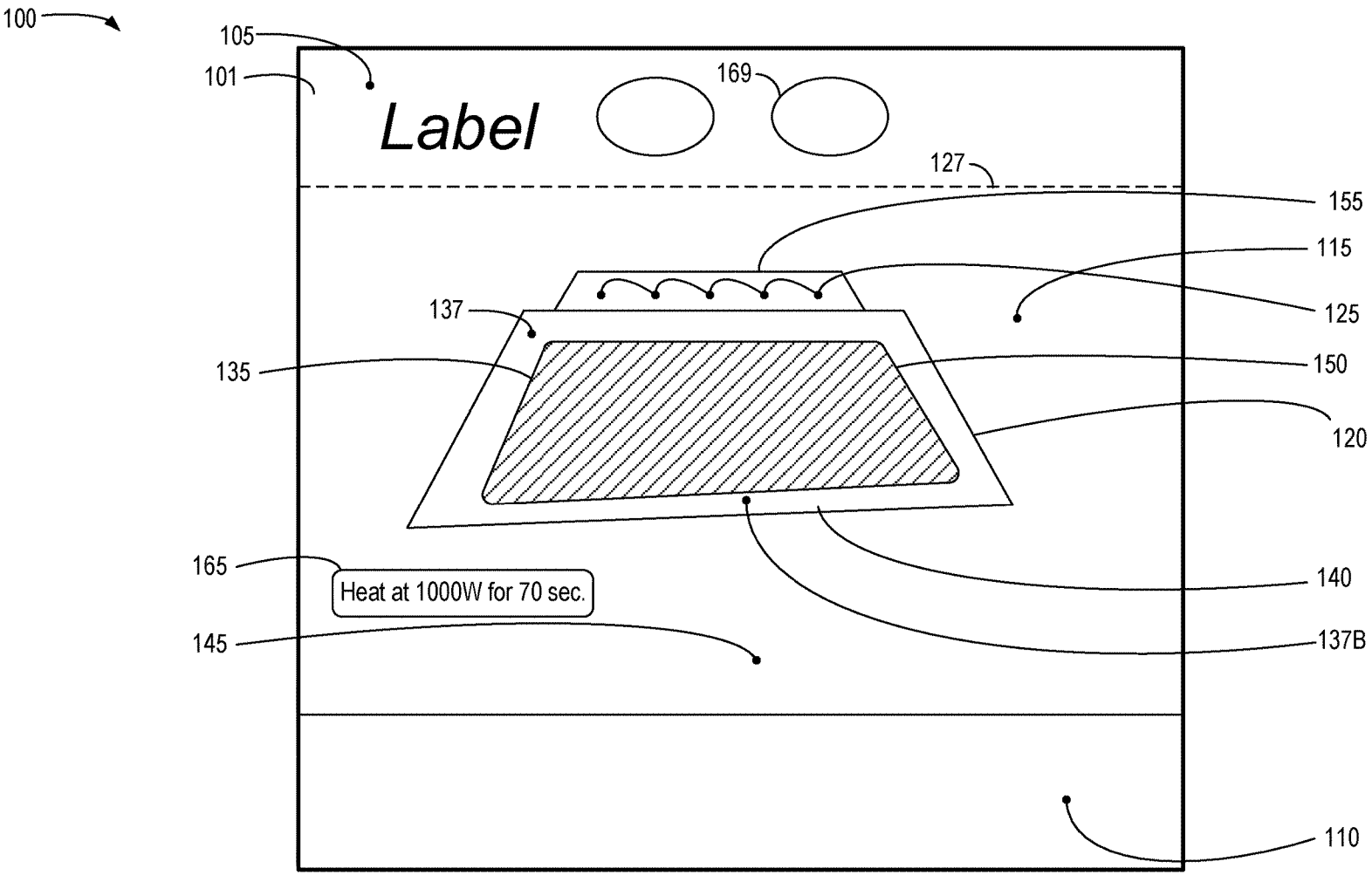
FIG. 1 depicts a view 100 of a disposable container (sans food) for heating food in accordance with one embodiment.

FIG. 1 depicts a view 100 of a stand-up pouch 101, a disposable container in accordance with one embodiment. Stand-up pouch 101 includes a pouch top 105 and a pouch bottom 110. A container sidewall 115 defines a pouch interior, which includes a food region 145 for containing food. A thermally breachable packet 120, containing a liquid 150, attaches 125 via tab 155 to sidewall 115 below what is or will become a seal 127 (e.g. a weld or zip-type seal). As depicted, liquid 150 is a 90/10 emulsion of butter and water, however, other ratios, liquid volumes, and parameters, e.g., as identified in FIG. 13, are selectable in various combinations to adjust the breach threshold. (In FIG. 13, the column identifying the time to a breach threshold is entitled "Rupture, Sec") For clarity of illustration and without limitation, attachment 125 is shown in FIG. 1 occurring at five points between tab 155 and sidewall 115.

Packet 120 includes a packet interior 135 defined within a seal 137 to contain a liquid (sauce) 150. Packet 120 has a packet bottom 140 facing pouch bottom 110. Liquid 150 is shown in FIG. 1 occupying most of the volume of packet interior 135. Seal 137 includes a bottom seal 137B, at the lower edge of packet interior 135, that lies approximately parallel to packet bottom 140. Stand-up pouch 101 also includes information 165 specifying a heating interval (70 sec.) and a power level (1000 W). The thermally breachable packet will breach within a fraction of the heating interval. Although information 165 is depicted as a label embodying readable text, the information may be in any format, e.g., QR-code, bar code label, embedded RFID, and so forth, and may be attached to or embedded in any portion of stand-up pouch 101, or stored in an on-line repository, e.g., in "cloud" storage physically separate from pouch 101. Accordingly, any manner of information retrieval may be used, e.g., a wireless handheld device such as a smartphone, a smartphone app, a barcode reader, an "Internet of Things" smart device, or an appliance such as a microwave oven, to read the information relating to the stand-up pouch, and set the power level and heating interval. This embodiment includes a label and grasping holes 169 above seal 127.

Figure 2:
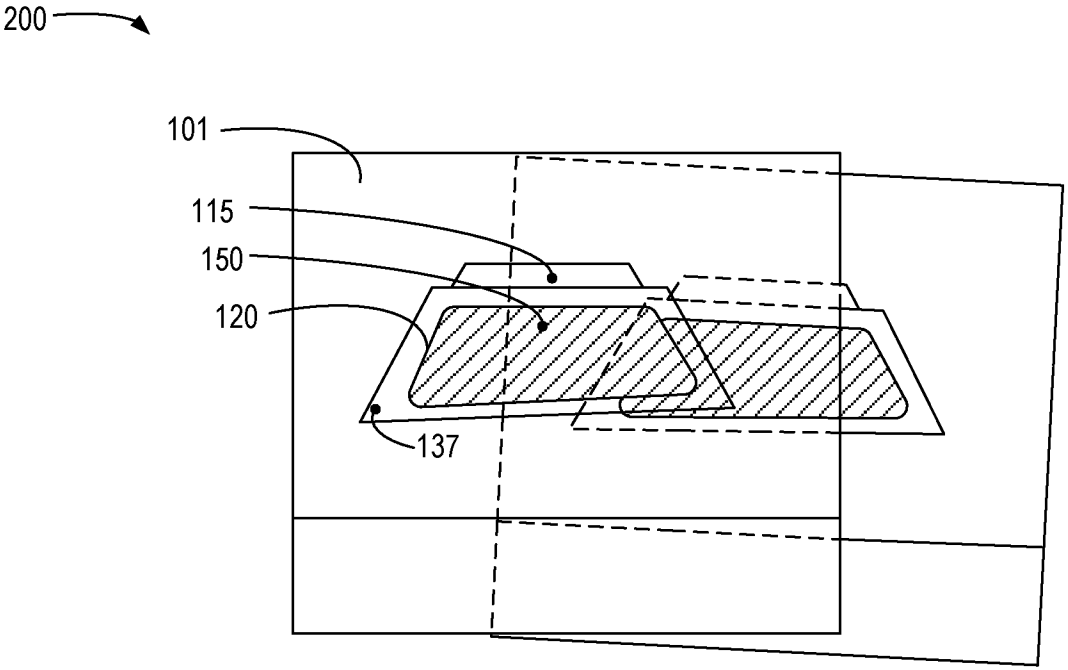
FIG. 2 depicts a view 200 of a plurality of stand-up pouches.

FIG. 2 depicts a view 200 of a plurality of pouches 101, each respectively including a packet 120 filled with liquid 150, and attached to a sidewall 115.

Figure 3:
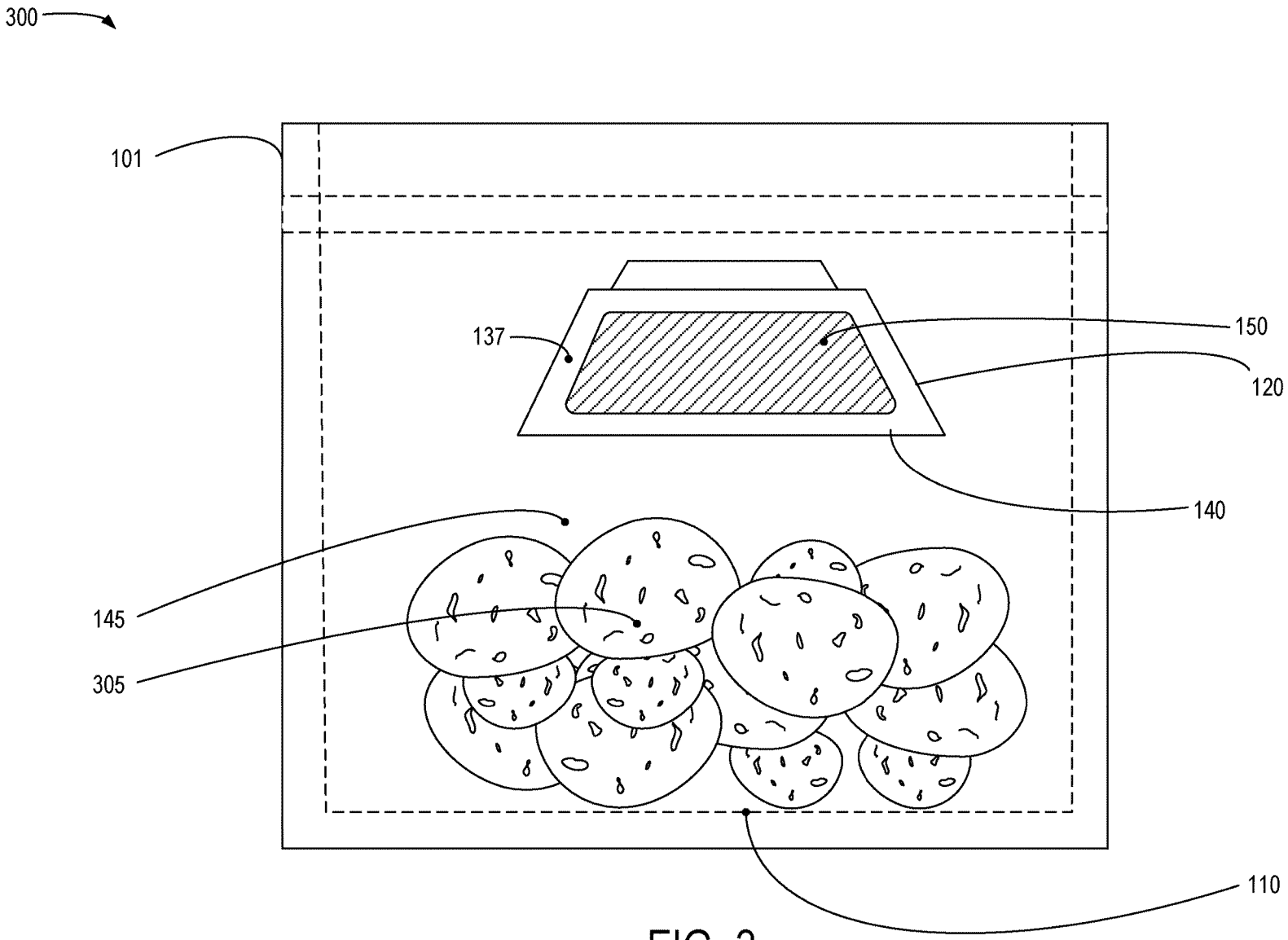
FIG. 3 depicts a view 300 of a stand-up pouch for heating food in accordance with another embodiment.

FIG. 3 depicts a view 300 of a stand-up pouch 101 containing a vegetable, here potatoes 305, in food region 145, in accordance with another embodiment. Note that pouch bottom 110 is expanded relative to the packet bottom depicted in view 100 to support potatoes 305 while pouch 101 is standing up. Packet bottom 140 faces pouch bottom 110 so that when packet 120 breaches during a heating interval, sauce 150 drains down onto potatoes 305.

Figure 4:
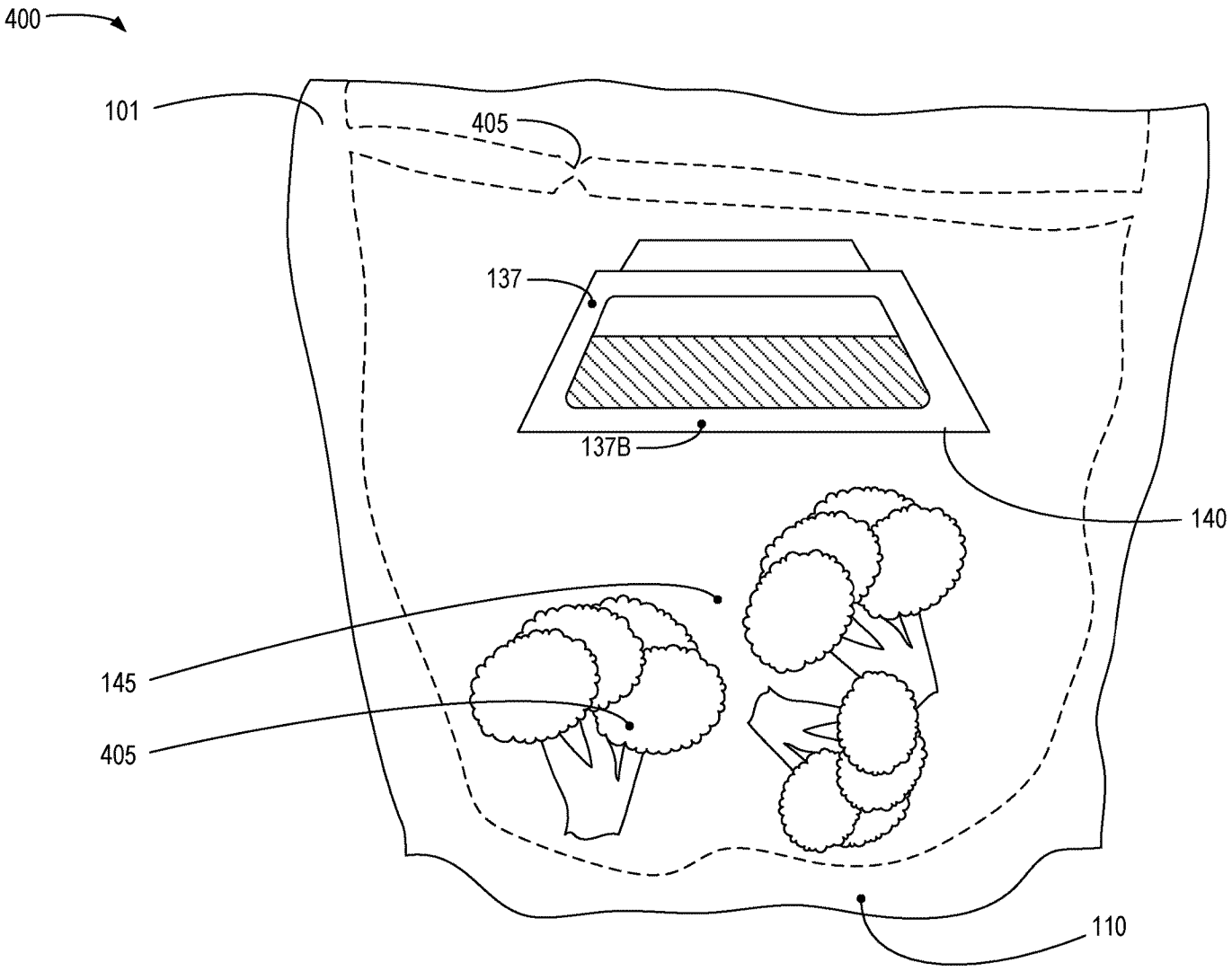
FIG. 4 depicts a view 400 of a stand-up pouch for heating food in accordance with another embodiment.

FIG. 4 depicts a view 400, similar to view 300, of stand-up pouch 101 containing broccoli 405 (rather than potatoes 305) in food region 145. Pouch 101 includes a vent 410 for the release of gases and pressure during cooking. Vent 405 is e.g. a small unsealed or weakly-sealed portion of the upper opening, but can be configured or located differently.

Figure 5:
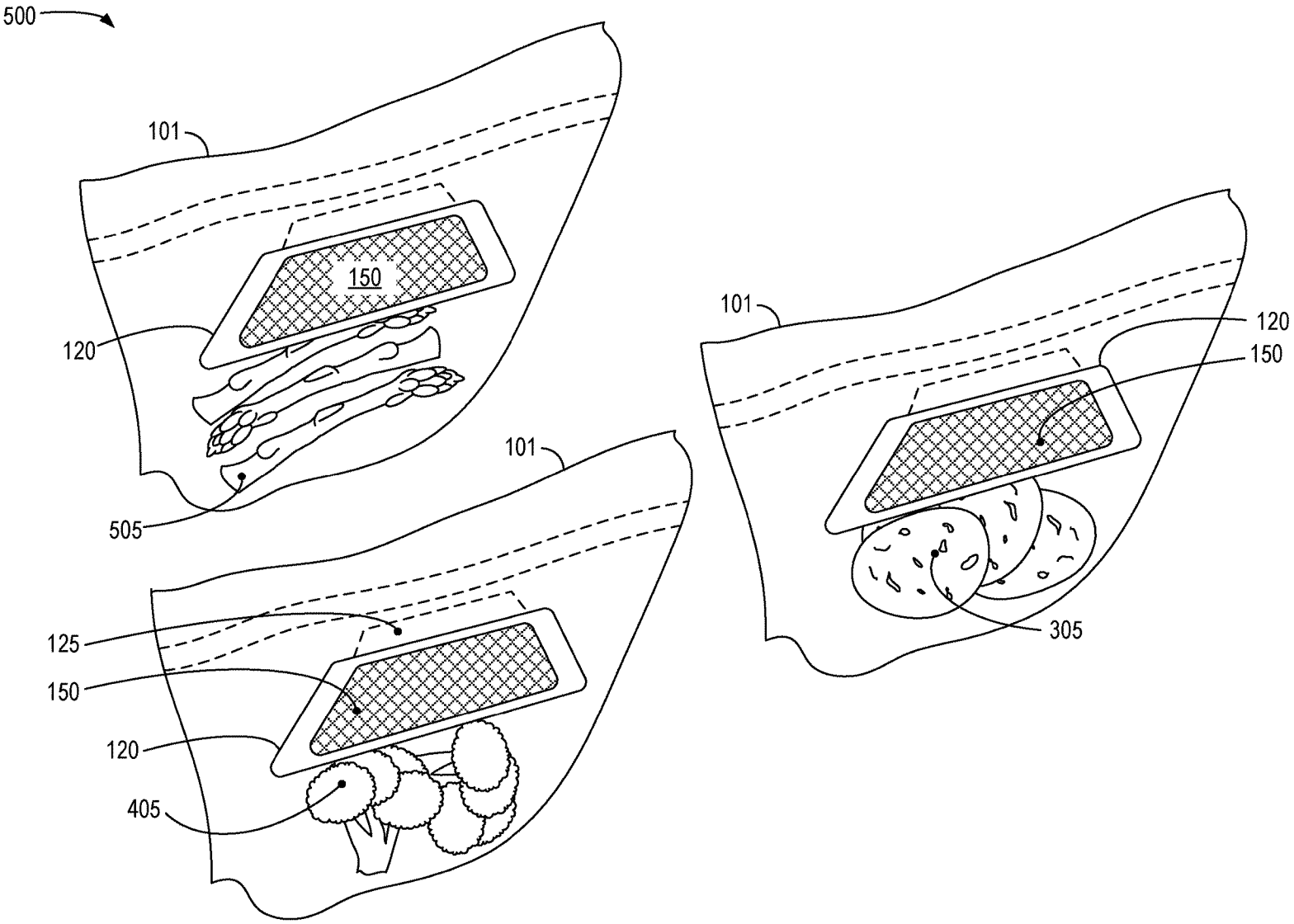
FIG. 5 depicts a view 500 of a plurality of stand-up pouches.

FIG. 5 depicts a view 500 of a plurality of stand-up pouches 101, variously containing potatoes 305, broccoli 405, and asparagus 505, in food regions 145 (not indicated in the figure for clarity of illustration). Packets 120 containing liquid 150 (as depicted, a sauce having a 90/10 butter/water emulsion) are situated above the food region so that when each packet 120 breaches during a heating interval, sauces 150 respectively drain onto potatoes 305, broccoli 405, and asparagus 505.

Figure 6:
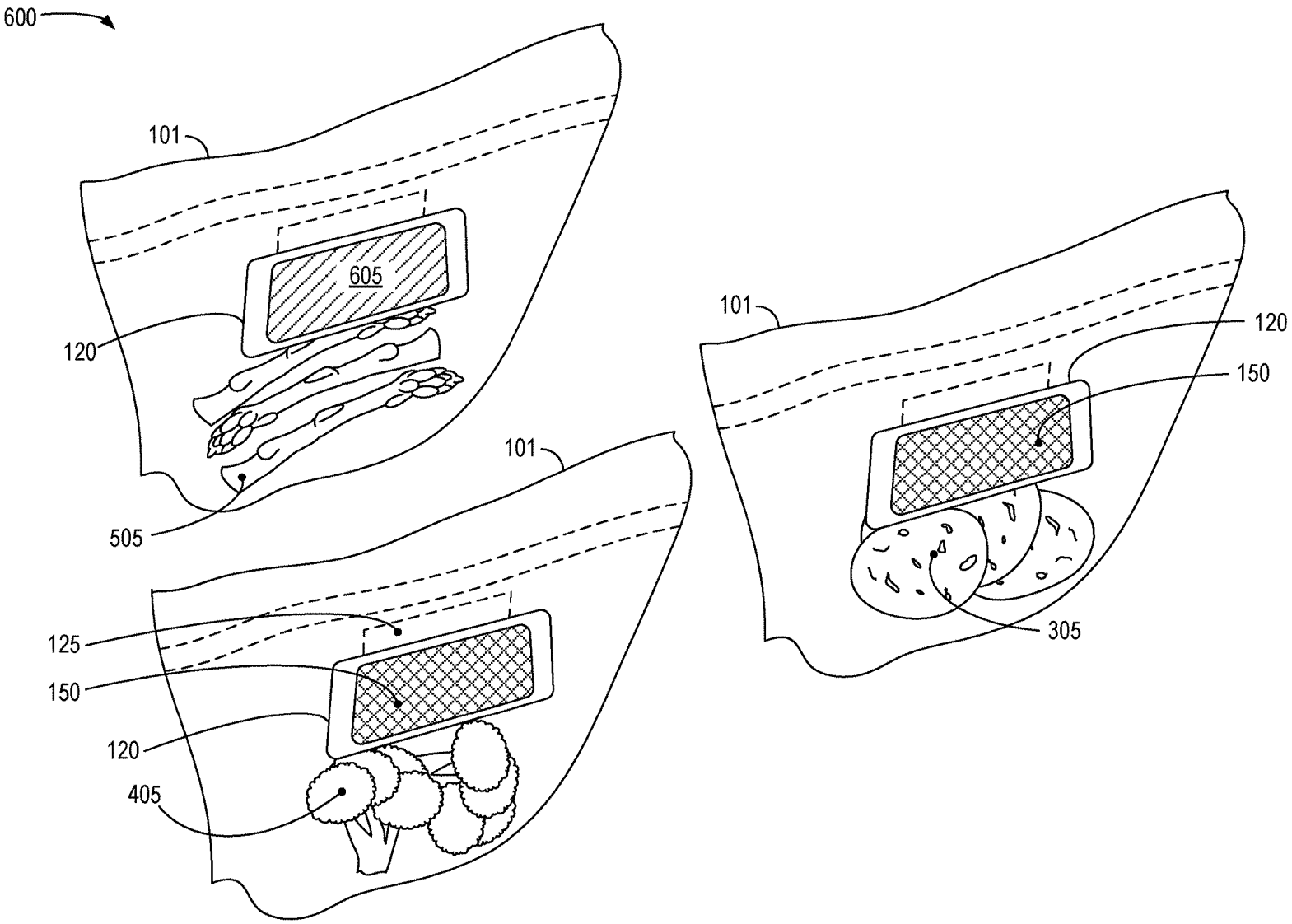
FIG. 6 depicts a view 600 of a plurality of stand-up pouches in accordance with another embodiment.

FIG. 6 depicts a view 600 of three pouches 101, containing respectively broccoli 405, potatoes 305, and asparagus 505, in accordance with other embodiments. The two packets 120 respectively above broccoli 405 and potatoes 305 contain liquid 150 in a 90/10 butter/water emulsion, and the packet 120 above asparagus 505 contains a liquid 605 comprised of a seasoned herbal and water combination. Sweet sauces, such as caramel with some water (over e.g. cut apples), have been effective, as have cheese sauces (over e.g. mixed vegetables) and other combinations of water, oil, seasoning, and sugar. For a given microwave oven, the combination of the sauce, the packet, and the load provided by the food all affect the time required for the packet to rupture. The sauce and respective packet are thus formulated to rupture at some fraction of the heating interval (e.g. cooking time) of the contents of the container.

Figure 7:
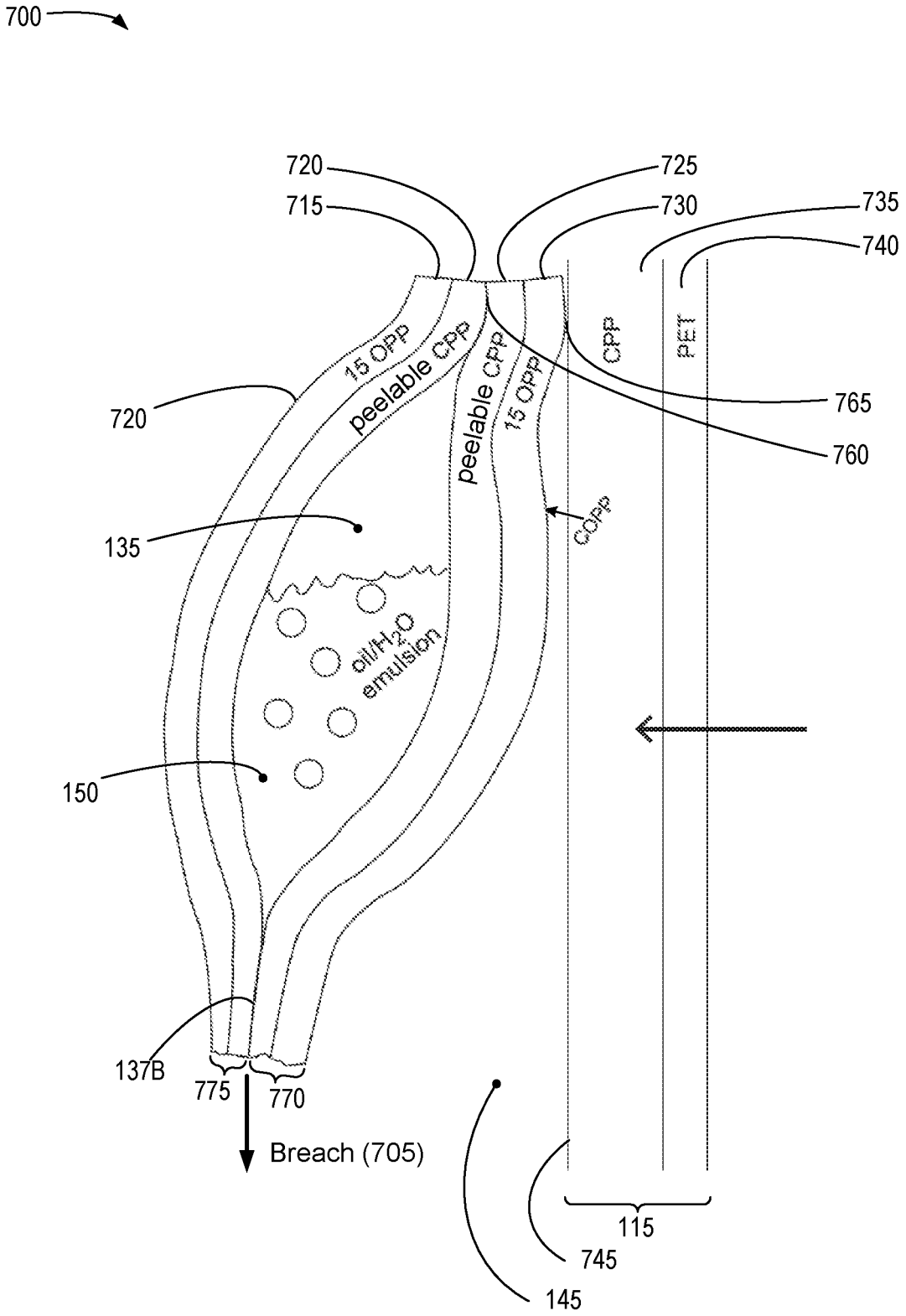
FIG. 7 depicts a side-wise schematic view 700 of a thermally breachable packet accordance with one embodiment.

FIG. 7 depicts a side-wise schematic view 700 of a thermally breachable packet 720 attached 765 to sidewall 115 of stand-up pouch 101 in accordance with one embodiment. Packet 720 is similar to packet 120, however, it lacks tab 155 and is accordingly attached to sidewall 115 in pouch interior 145 using a fusion seal. Sidewall 115 is comprised of an olefin polymer, Cast Polypropylene ("CPP") 735 forming inner pouch surface 745, laminated to Polyethylene Terephthalate ("PET") 740. Sidewall 115 may be constructed as rollstock, suitable for production on an inserter machine. Notably, the combination of CPP and PET results in a stand-up pouch compliant with FDA regulations at 21 CFR 177.1520 and 21 CFR 176.170, including Tables I, II, and 3a.

As with packet 120, packet 720 includes packet interior 135 containing liquid 150, depicted as an "oil/$H_2O$ emulsion" partially filling packet interior 135. Packet 720 is comprised of a first (bottom) web 770, a laminate of at least two olefin polymers including Oriented Polypropylene ("OPP") 735 and peelable CPP 725, and a second (top) web 775, a laminate of OPP 715 and CPP 720. Bottom and Top Webs 770 and 775 may be constructed as rollstock for volume production on conventional pouch filling equipment, e.g., a vertical pouch filler. Note that top and bottom webs 770 and 775 may be of identical thickness, however, each component 735 and 725 of web 775, and 715 and 725 of web 770, may be adjusted as needed to facilitate attaching packet 720 to sidewall 115, and to adjust the breach threshold.

CPP 720 and 725 are joined by a peelable heat seal 760 (upper portion of packet 720) and bottom seal 137B (lower portion of packet 720). The CPP (identified as "peelable CPP") in FIG. 7 exhibits lower cohesive strength than a fusion weld. Thus, laminates 720 and 725 can be made to separate from one another under controlled circumstances in response to a pressure build-up caused by liquid 150 expanding during a heating interval. In other words, laminates 720 and 735 "breach" when pressure exerted on seal 137B reaches a breach threshold. While yielding these beneficial aspects, the aforementioned combination of laminates also results in a packet that is compliant with FDA regulations at 21 CFR 177.1520 and 21 CFR 176.170, including Tables I, II, and 3a, for a packet having components, e.g., olefin polymers, used in stand-up pouch 101 and packet 720 (also packet 120) that come in contact with aqueous and fatty foods.

During the heating interval, liquid 150 heats and expands, resulting in a pressure build-up inside packet interior 135, the expanding liquid and pressure tending naturally to be spherical in shape. Experimental results confirm that shaping packet interior 135 asymmetric with respect to the spherical expanding liquid and pressure build-up directs the pressure and liquid 150 toward packet bottom 140 (the longest side of packet interior 135) and bottom seal 137B. The pressure and liquid thus directed exert disproportionate pressure and heated liquid 150 against bottom seal 137B, causing it to breach (705) first. Note that packet interior 135, shown in FIG. 1, is non-rectangular. As depicted, it is a four-sided polygon having three shorter sides, one longer side (packet bottom 140), and is asymmetrically shaped with respect to a spherical expansion of liquid 150 in accordance with one embodiment.

Packet interior 135 is similarly shaped as depicted in FIGS. 2-5, and 9-13. Variations of packet interior 135 are depicted in FIG. 6. The packet interior 135 is shaped to direct the pressure build-up toward a particular region, here, packet bottom 140, causing that region to be the first to breach. Directing the pressure build-up and liquid by adjusting the shape of packet interior 135 is one element for adjusting the breach threshold. The desired breach region can also be made relatively weak. For example, the peelable sealant formulation described above offering lower cohesive strength than a fusion seal is employed to further facilitate achieving an adjustable breach threshold. Other elements, including packet interior volume, seal locations, patterns and dimensions, and inclusion of a stress concentrator, will be described more fully below in connection with FIGS. 9-13. Although packet bottom 140 is the region to which the liquid and pressure build-up are directed in the embodiments depicted in FIGS. 1-6, and 9-13, a side, top, or other region could as easily have been selected.

Figure 8:
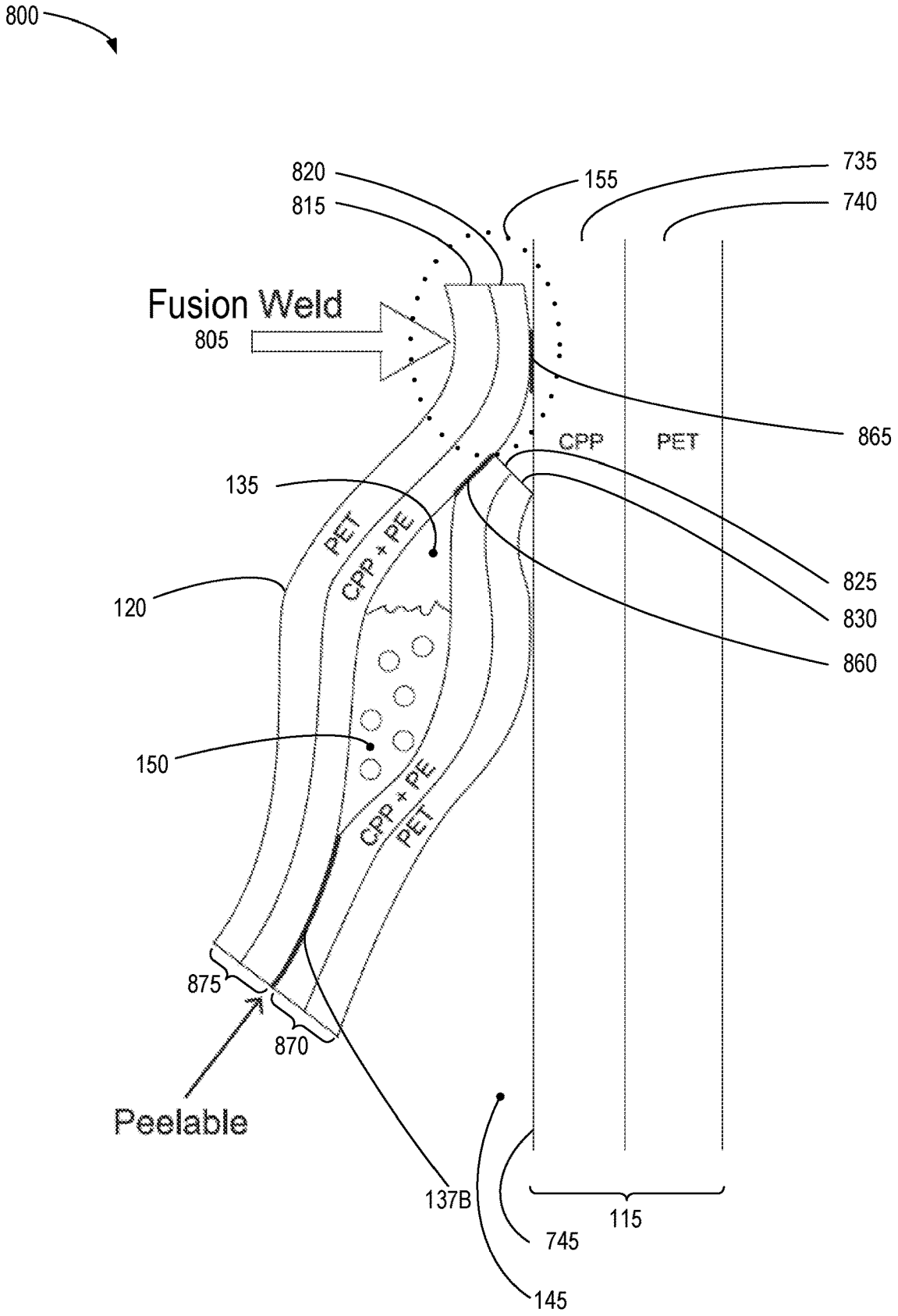
FIG. 8 depicts a side-wise schematic view 800 of a thermally breachable packet having a tab in accordance with another embodiment.

FIG. 8 depicts a side-wise schematic view 800 of packet 120 in accordance with one embodiment. Packet 120 is similar in many respects to packet 720 described with respect to FIG. 7. Accordingly, and for the sake of brevity, differences between packets 720 and 120 are described below. Packet 120 includes tab 155 (shown within a dotted oval), connected (attached) 865 via a fusion weld 805 to sidewall 115 in stand-up pouch interior 145. Sidewall 115 is comprised of a laminate of PET 740 and CPP 735, with CPP 735 facing the stand-up pouch interior 155. Packet 120 is comprised of a first (bottom) web 870 and a second (top) web 875. Web 875, the upper portion of which forms tab 155, is comprised of a laminate of CPP+PE (polyethylene) 820 and PET 815. Because two CPP laminates are in contact (CPP 820 of tab 155 contacts CPP 735 of sidewall 155), connection 865 is cost-effectively joined with a simple fusion weld, and the resulting connection 865 is robust. Similar to second web 875, first web 870 is comprised of CPP+PE 825 and PET 830. As described with respect to packet 720, bottom seal 137B is formed between two peelable CPP laminates (here, 820 and 825), resulting in a "peelable" cohesive seal 137B that breaches when pressure exerted on it by liquid 150 expanding during a heating interval, reaches the breach threshold. A pouch vent (e.g. vent 415 of FIG. 4) ruptures early in a heating interval when the container first fills with steam, and likely before seal 137B is breached. In other embodiments the laminate could be e.g. OPP or biaxially oriented polypropylene, polyamide, or any other similarly heat resistant outer layer; and the inside layer instead of CPP (cast polypropylene) could be any other sealable film or coextrusion that has a heat seal layer that seals at a lower temperature than the PET, OPP, BOPA, etc., like HDPE, MDPE or blown polypropylene. In other embodiments the peelable CPP could be peelable High density PE or peelable MDPE.

Figure 9:
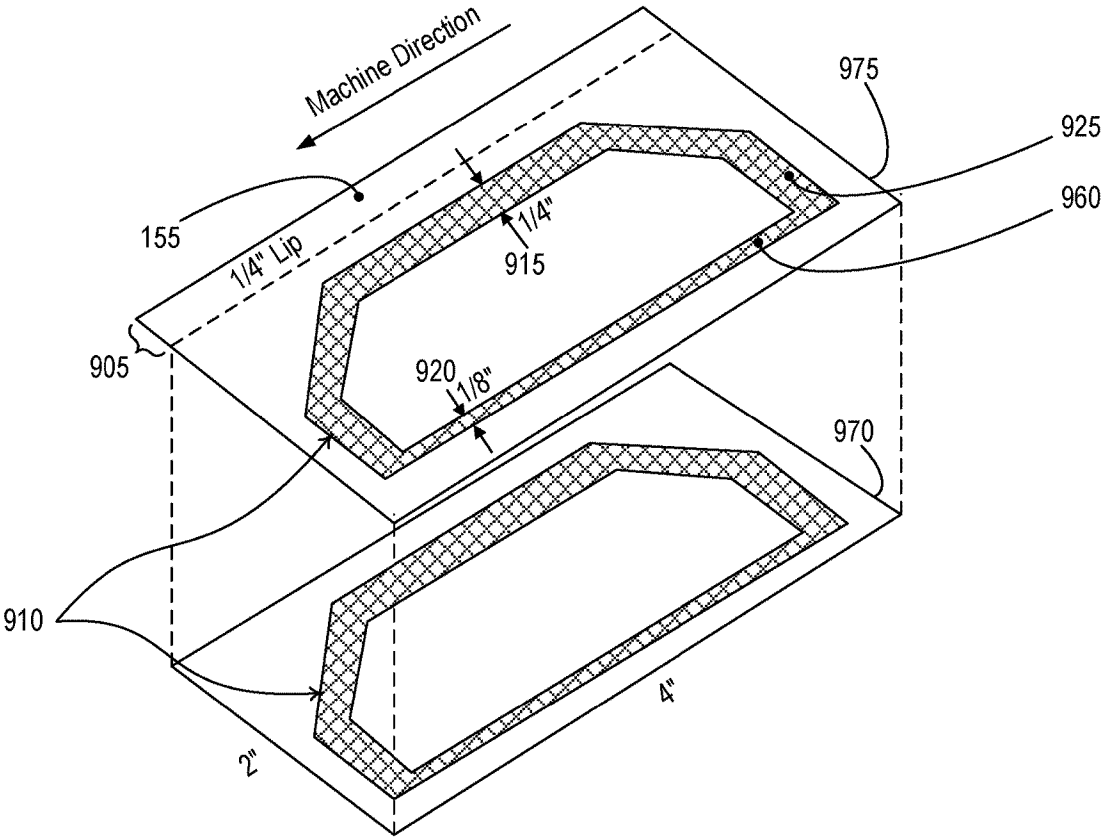
FIG. 9 is a schematic view of a section of rollstock for forming a thermally breachable packet in accordance with one embodiment.

FIG. 9 is a schematic view of a section of rollstock 900 for forming a thermally breachable packet in accordance with one embodiment. The view also includes additional detail with respect to bottom seal 137B. Rollstock 900 is comprised of first (bottom) web 970 and second (top) web 975 which, when joined on production machinery such as a pouch filler and filled with a liquid such as liquid 150, results in a thermally breachable packet such as packets 120 and 720. Second web 975 includes additional material 905, depicted in FIG. 9 as an additional one-quarter inch ('¼" Lip') with respect to first web 970. Material 905 forms tab 155 after the first and second webs are joined on the pouch filler. Material 905 is adjusted to a dimension other than one-quarter inch in accordance with other embodiments. Similarly, first and second web outside dimensions (2" and 4" as depicted in FIG. 9 with respect to the first web) are adjusted to dimensions other than those depicted in FIG. 9 in accordance with other embodiments.

A seal pattern 910 (depicted as a six-sided polygon to direct pressure and liquid in packet interior 135 during heating toward bottom seal 137B as discussed above) comprises seal patterns 925 and 960 (corresponding to bottom seal 137B), and seal dimensions 915 and 920 (corresponding to bottom seal 137B). Patterns 925 and 960, and dimensions 915 and 920, are varied to adjust the breach threshold in accordance with various embodiments. Typically, bottom seal pattern 960 and the dimensions are adjusted so that bottom seal 137B breaches before other portions of the seal. As depicted, bottom seal dimension 920 (⅛") is one-half the width of seal dimension 915 (¼"). Consequently, and assuming identical seal patterns 925 and 960, bottom seal 137B will breach before other portions of the seal. The seal widths are uniform in other embodiments, and can be minimized while satisfying the structural requirements imposed by handling and use.

Figure 10:
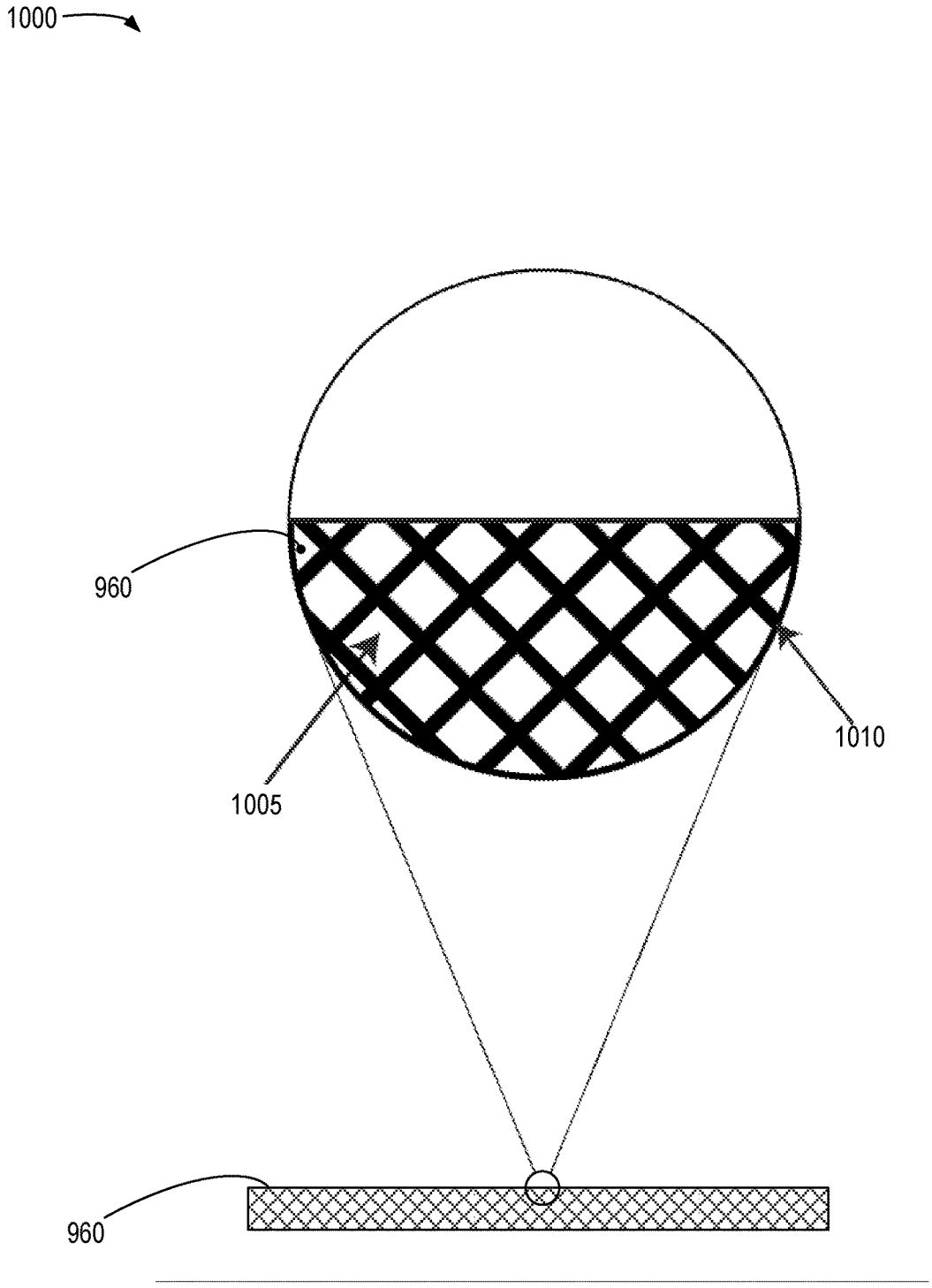
FIG. 10 depicts view 1000, an enlarged view of a bottom seal in a cross-hatched pattern in accordance with one embodiment.

FIG. 10 depicts view 1000, an enlarged view of bottom seal 960 in a cross-hatched pattern in accordance with one embodiment. Seal pattern 960 includes unsealed area 1005 and sealed area 1010, resulting in a reduced contact area (ratio of sealed to total area) of less than 100%. Portions of the seal other than seal pattern 960 are typically at 100% contact area. Notably, the crosshatch pattern depicted in view 1000 is continuous along both dimensions of seal 960, which avoids leakage past the seal incident to typical seal configurations, e.g., "dots." Seal contact area is proportional to peel strength; lower peel strength requires lower pressure to achieve a breach threshold. Accordingly, to lower the breach threshold, e.g., to cause a breach to occur earlier in the heating cycle, the contact area is reduced relative to the seal area to lower the seal peel strength. The crosshatch pattern is easily machined into a conventional seal bar used on conventional pouch filling equipment. Other sealing patterns can be used to reduce contact area, and these can be continuous along a dimension of the seal to and avoid leakage.

Figure 11:
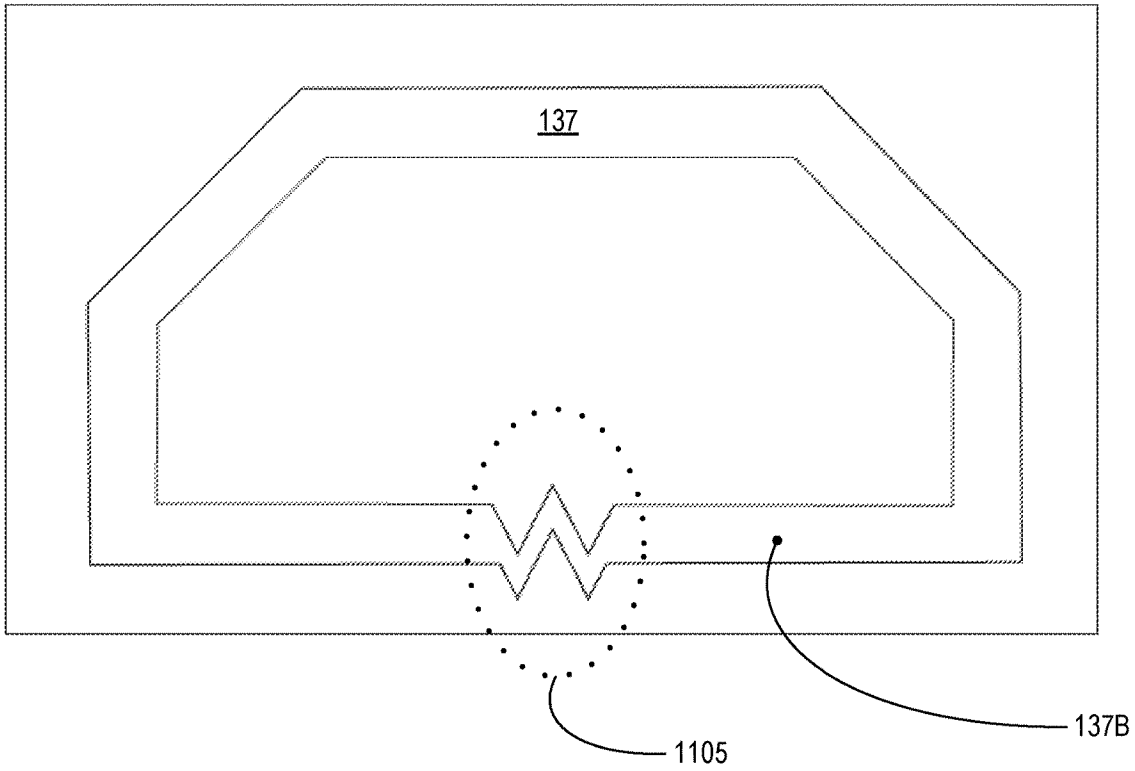
FIG. 11 depicts view 1100 of a seal pattern incorporating a stress concentrator in accordance with one embodiment.

FIG. 11 depicts view 1100 of a seal pattern incorporating stress concentrator 1105 in bottom seal 137B. Stress concentrator 1105 further focuses pressure directed toward bottom seal 137B in the concentrator itself, which increases the likelihood of a breach occurring at the site of concentrator 1105. As depicted, stress concentrator 1105 is fashioned as an inverted "V" positioned between two bottom "V" shapes. In response to the pressure build-up incident to heating liquid 150, the inverted "V" breaks through to the bottom "Vs" before it would otherwise "bottom out." Accordingly, bottom seal 137B breaches at the location of stress concentrator 1105. As is known to those of skill in the art, stress concentrators can take many forms.

In some embodiments the heat-seal temperature and pressure can vary during the formation of different parts of seal 137 to bias bottom seal 137B to rupture. For example, all or a portion of bottom seal 137B can be formed at a lower temperature or pressure than the remaining areas of seal 137. Heat-seal strength can also be reduced by increasing pressure to squeeze out or otherwise impair an intervening seal layer.

Figure 12:
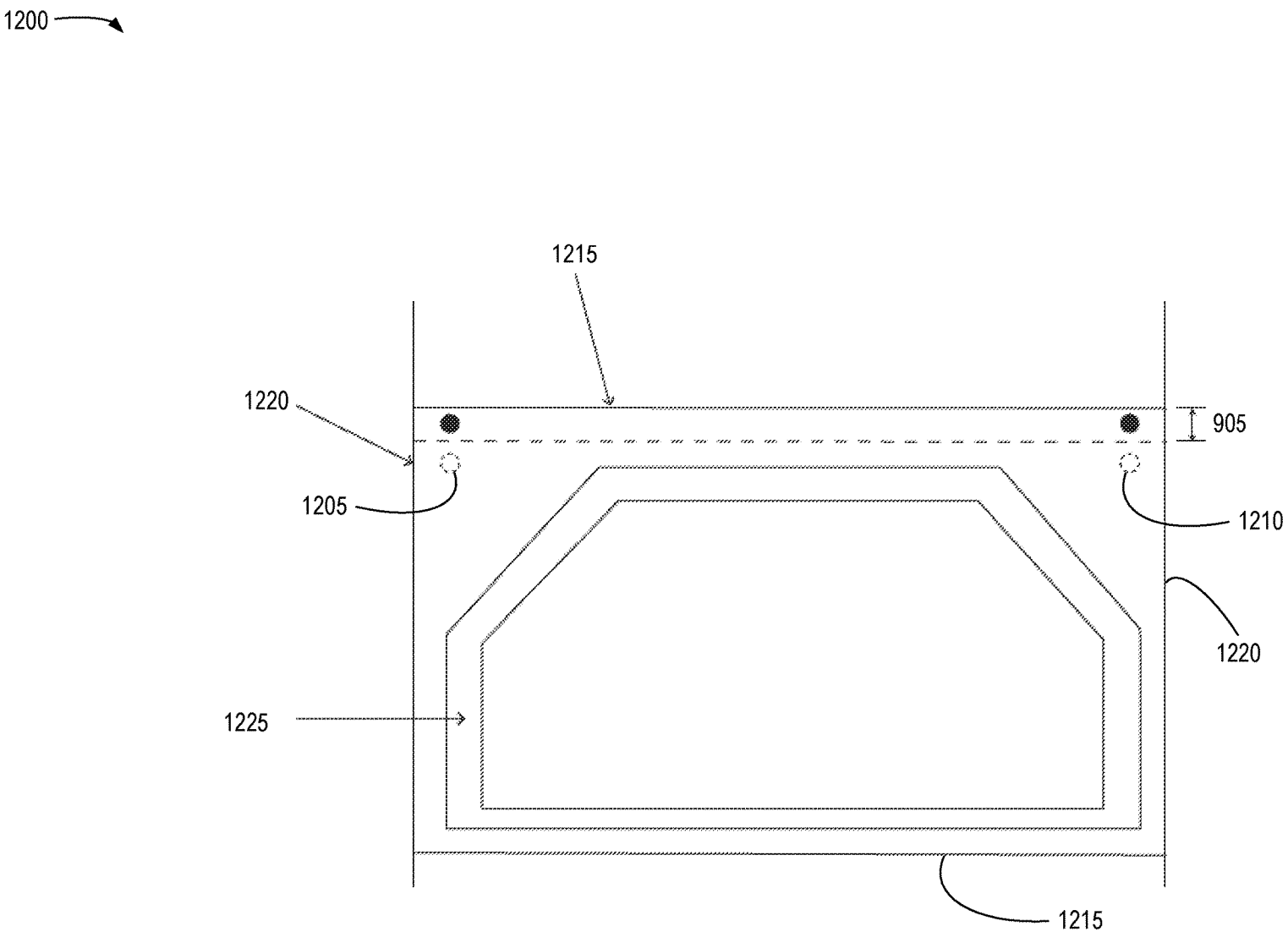
FIG. 12 depicts a view of a section of rollstock 1200 having filled and sealed packets in accordance with one embodiment.

FIG. 12 depicts a view of a section of rollstock 1200, showing a packet 120 and seal 1225 after the packet has been filled and sealed. A plurality of sealed, filled packets 120 are attached to one another via top and bottom perforations 1215, and stored on a roll (shown in FIG. 17) for future insertion into partially made stand-up pouches. Lip 905 becomes tab 155 once the packets are separated at top and bottom perforations 1215. Blind holes 1205 and 1210 in the first (bottom) web facilitate the fusion weld 805 to the CPP 820 laminate on the second (top) web 875 in FIG. 8, and a weld to CPP 720 laminate on the second (top) web 775 in FIG. 7. Both lip 905 and blind holes 1205 and 1210 facilitate sealing to the inner wall of the SUP, and either or both can be used.

FIG. 13 depicts a table 1300 showing experimental results of nine trials involving varying combinations of liquid 150 (sauce) volume, butter/water ratios, stand-up pouch heights, vegetable (Broccoli) weight, and the resulting time to achieve breach (identified in the table as "Rupture, Sec") of thermally breachable packet 120. A number of important conclusions are evident from table 1300, and from other experimentally derived observations. First, some butter (oil or fat) with water reduces the time to achieve breach over broccoli. Second, butter heats faster than water, and it heats water inside the packet preferentially over water heating on its own within the produce. Third, butter accelerates the rate at which water in the packet boils. Fourth, the higher the volume of liquid, the longer it takes to reach the breach threshold. Fifth, the amount of food in the food region does not appreciably affect the time it takes to reach the breach threshold. Sixth, a higher oil-to-water ratio results in a shorter time to reach the breach threshold. Seventh, an oil/water emulsion reaches the breach threshold before a non-emulsion combination of oil and water. Eighth, some water must be present for a breach of the thermally breachable packet to occur at all.

Figure 14:
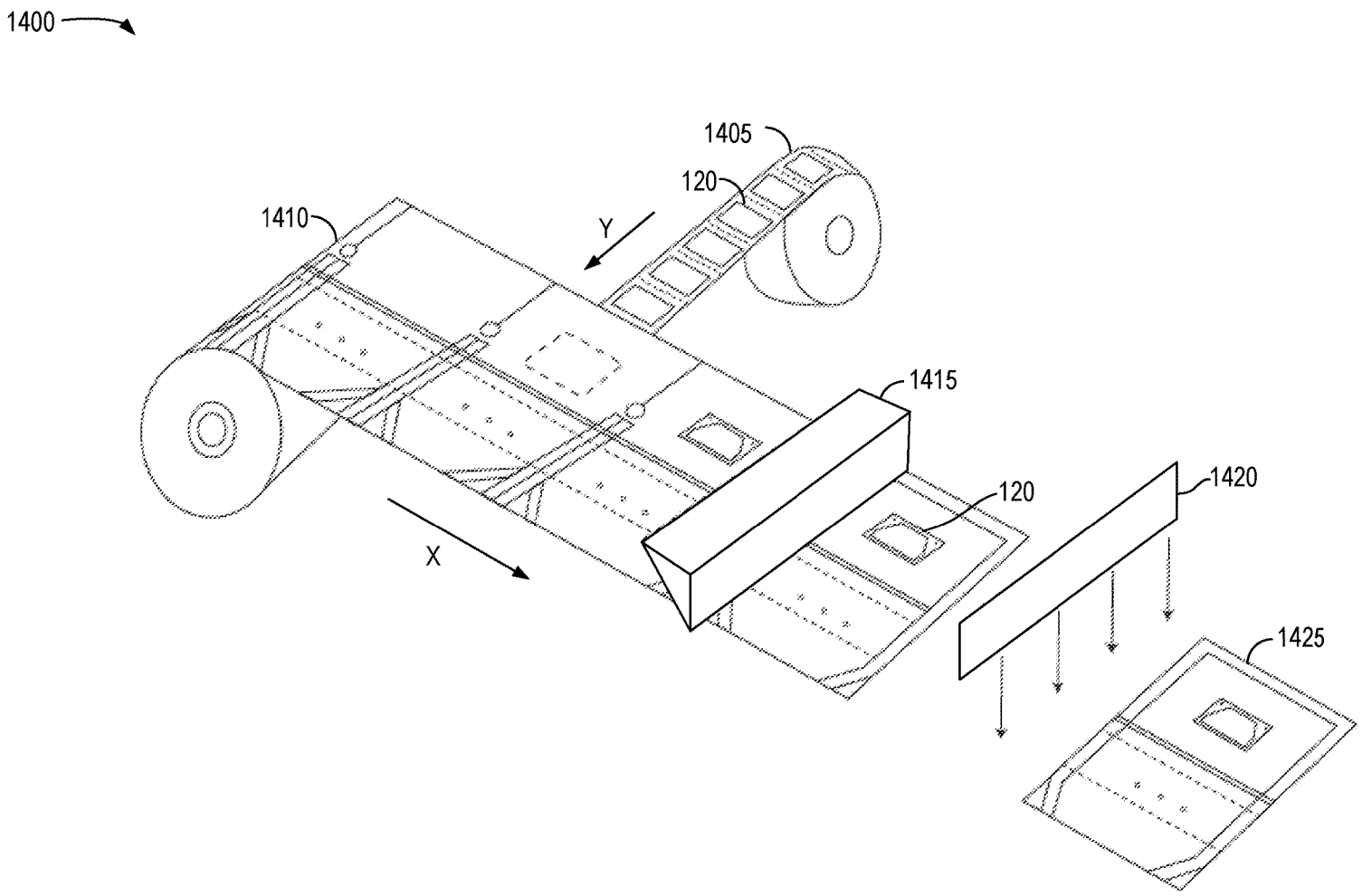
FIG. 14 depicts a view 1400 of an inserter machine to insert sealed thermally breachable packets into partially made stand-up pouches.

FIG. 14 depicts a view 1400 of an inserter machine to insert sealed (and filled with liquid), thermally breachable packets 120 on rollstock 1405, e.g., as described with respect to FIG. 12, into partially made stand-up pouch rollstock 1410. Each partially made stand-up pouch has a pouch top, a pouch bottom, and at least one container sidewall for defining a pouch interior. The machine unwinds the partially made stand-up pouch rollstock, feeding it in a first direction X. While feeding the partially made standup pouch in a first direction, the machine inserts the packet from a second direction Y (typically, approximately orthogonal to the first direction), and attaches the sealed, breachable packet 120 to the pouch interior. In one embodiment, the insertion occurs by the machine unwinding the sealed, breachable packet from rollstock or fanfold format (typically separated by perforations from other sealed, breachable packets). The attaching is done by a heat sealer 1415 (fusion welder) in accordance with one embodiment. The feeding in first direction X is done on a first conveyor in accordance with one embodiment. The feeding in a second direction is done on a second conveyor in accordance with yet another embodiment. A knife cutter 1420 frees each completed stand-up pouch 1425, which may then be filled with food using an inserter machine (not shown).

Figure 15:
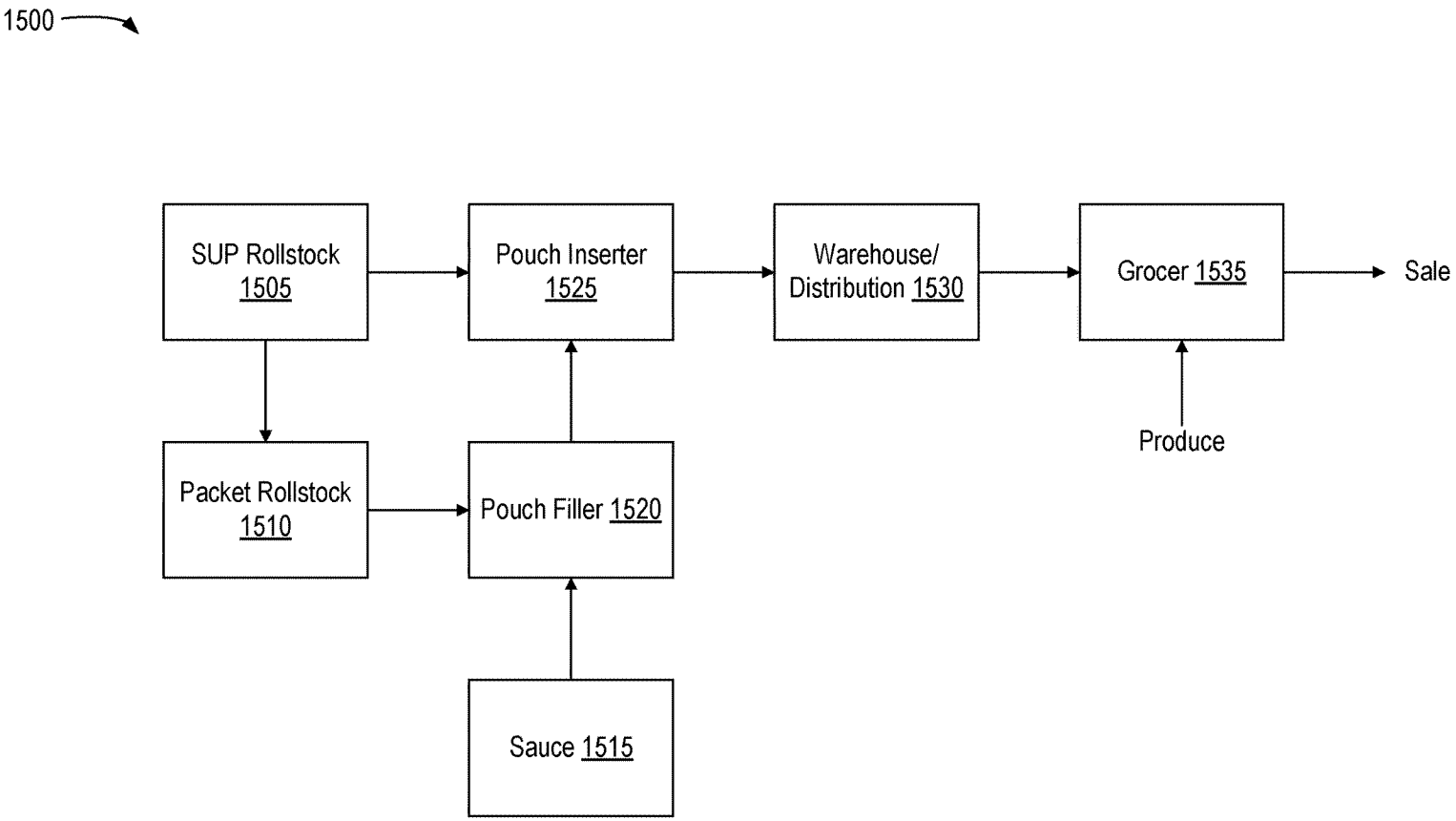
FIG. 15 depicts a view 1500 of a flow diagram depicting material flow and steps to use pouch filler and inserter equipment to produce a stand-up pouch for heating food in accordance with one embodiment.

FIG. 15 depicts a view 1500 of a flow diagram depicting material flow and steps to insert liquid into partially made packets and seal the partially made packets on pouch filler equipment so that the liquid is contained in a sealed, thermally breachable packet; insert the sealed, thermally breachable packets on rollstock into partially made stand-up packets on an inserter machine; and provide finished product to a warehouse.

The process begins with partially made stand-up pouch roll stock 1505, breachable-packet rollstock 1510, and some sauce 1515. A pouch filler 1520 fills packet rollstock 1510 with sauce 1515, and an inserter machine 1525 inserts and welds the resultant breachable packets into the partially made SUP rollstock. The completed stand-up pouches can then be filled with e.g. produce and sealed, or can be warehoused and distributed (1530) to points on the supply chain closer to the consumer, such as to a restaurant, packager, or grocer 1535 for sale to the public. Some embodiments include an end-user seal, such as a zip-top or tie, for the produce opening. Stand-up pouches equipped with sauce packets can be filled in mass using conventional filling and sealing machines, or can be filled individually by end users.

Figure 16:
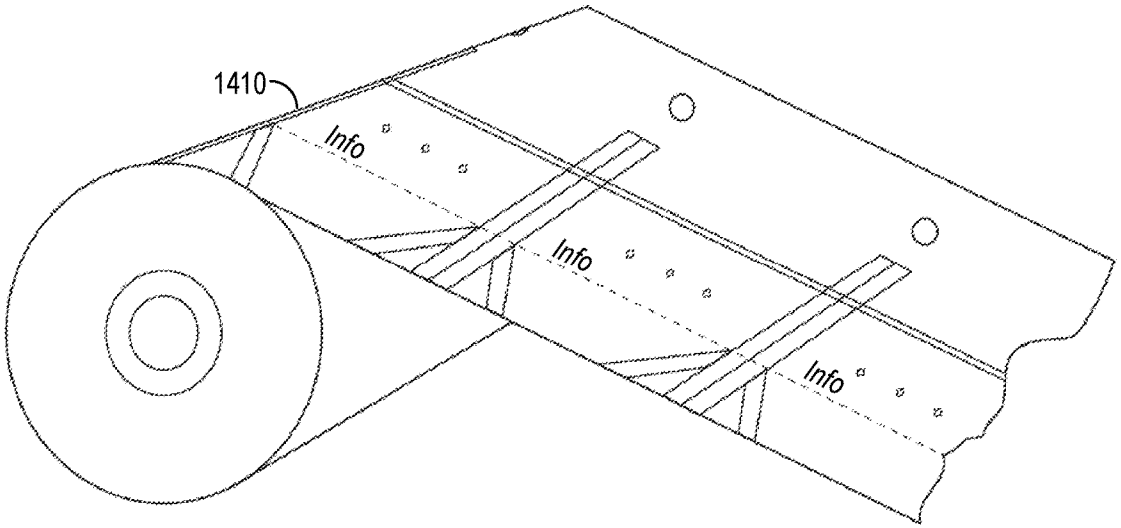
FIG. 16 depicts a view 1600 of a partially made stand-up pouch in accordance with one embodiment.

FIG. 16 depicts a view 1600 of rollstock 1410 of FIG. 14, a roll of partially made stand-up pouches in accordance with one embodiment. As detailed previously, each partially made stand-up pouch includes information Info specifying a heating interval and power level, a bottom gusset, a K-Seal, a microwave vent channel, laser micro-perforations, and a partial side seal. The vent channel can take the form of a frangible chimney, laser slits, etc. In a conventional frangible chimney, a hole placed in a seal area provides a controlled rupture. When the pouch expands with steam, the seal delaminates at the hole and vents through the chimney.

Figure 17:
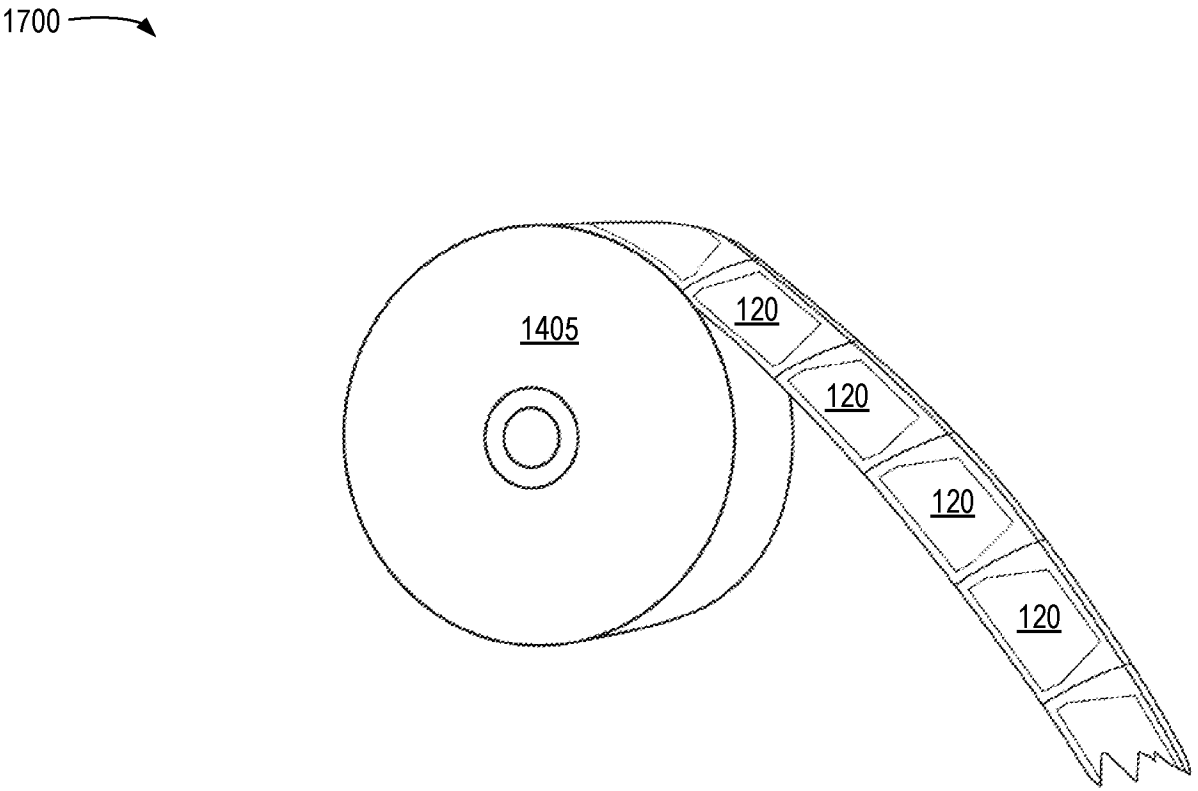
FIG. 17 depicts a view 1700 of a filled packet on rollstock in accordance with one embodiment.

FIG. 17 depicts a view 1700 of rollstock 1405 of FIG. 14, a roll of filled packets, e.g., packet 120 or 720, e.g., as also depicted with respect to FIG. 12. The rollstock is comprised of OPP/CPP laminates, is filled with liquid, and includes perforations between individual packets. The rollstock may be stored on a roll, or it may be stored in a "fanfold" configuration in a box. Other laminates may also be used.

Figure 18:
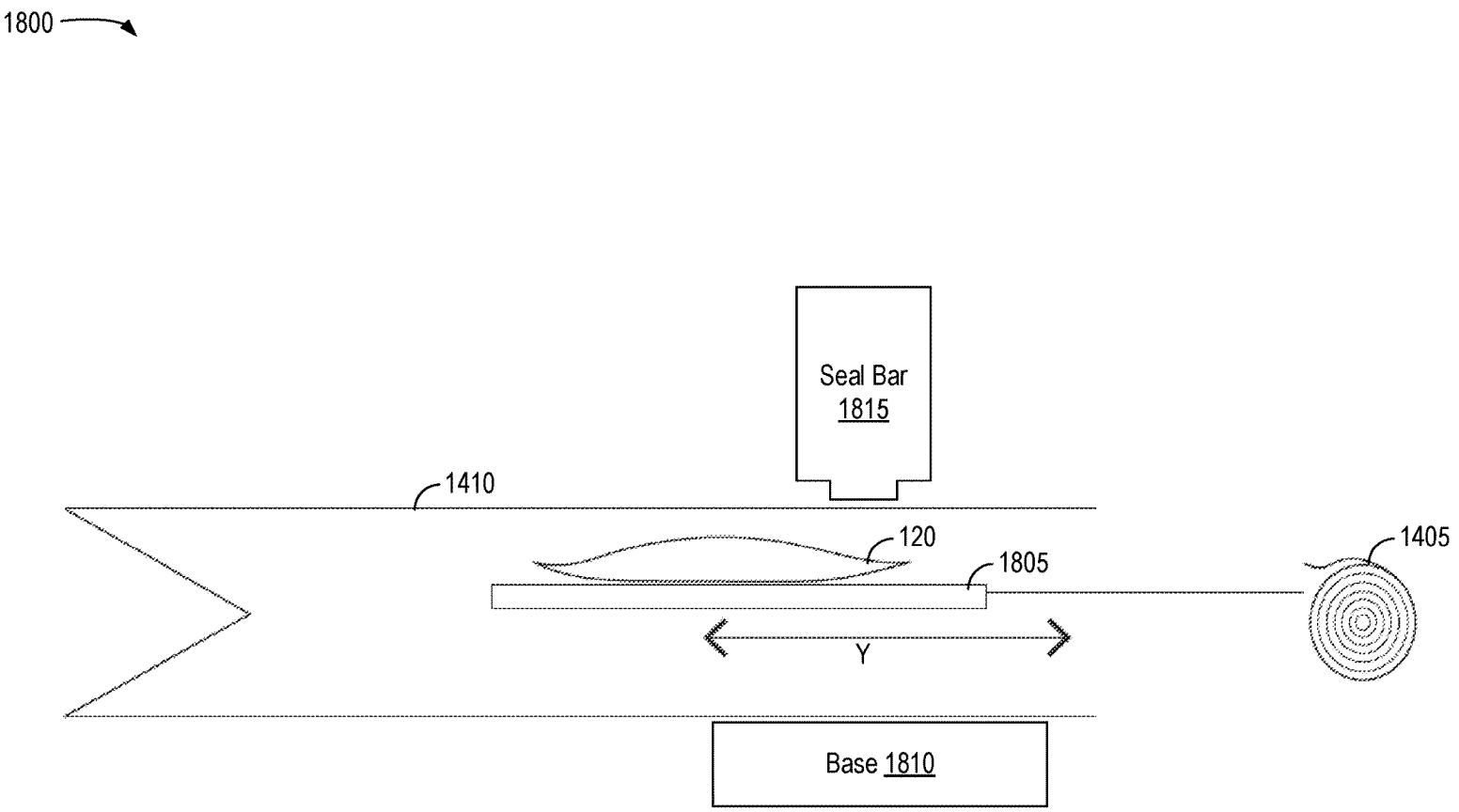
FIG. 18 is a side view 1800 of an inserter machine showing a partially-made stand-up pouch rollstock, shuttle, base, and seal bar in accordance with one embodiment.

FIG. 18 is a side view 1800 of an inserter machine showing a partially made stand-up pouch rollstock 1410, a shuttle 1805 to feed packets 120 from rollstock 1405, a base 1810, and seal bar 1815 in accordance with one embodiment.

Figure 19:
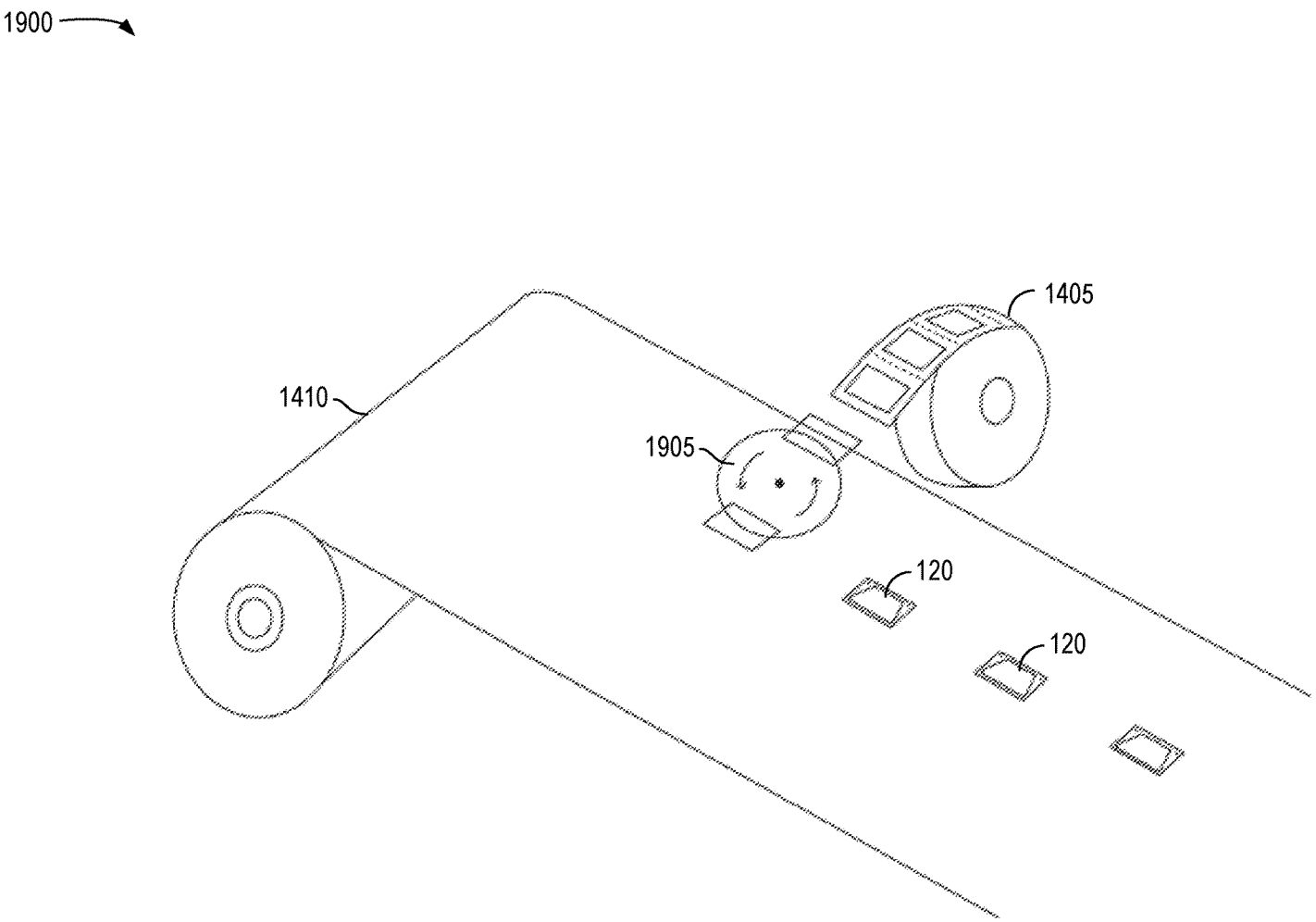
FIG. 19 is a view 1900 of a rotary inserter machine in accordance with one embodiment.

FIG. 19 is a view 1900 of a rotary inserter machine in accordance with one embodiment. As an alternative to the shuttle depicted in FIG. 18, the rotary inserter machine uses a wheel 1905 to preload and rotate the sealed, breachable packet 120 from rollstock 1405 into the stand-up pouch interiors of rollstock 1410. The rotary inserter machine results in a shorter cycle time than the inserter machine employing the shuttle depicted in FIG. 18.

Figure 20:
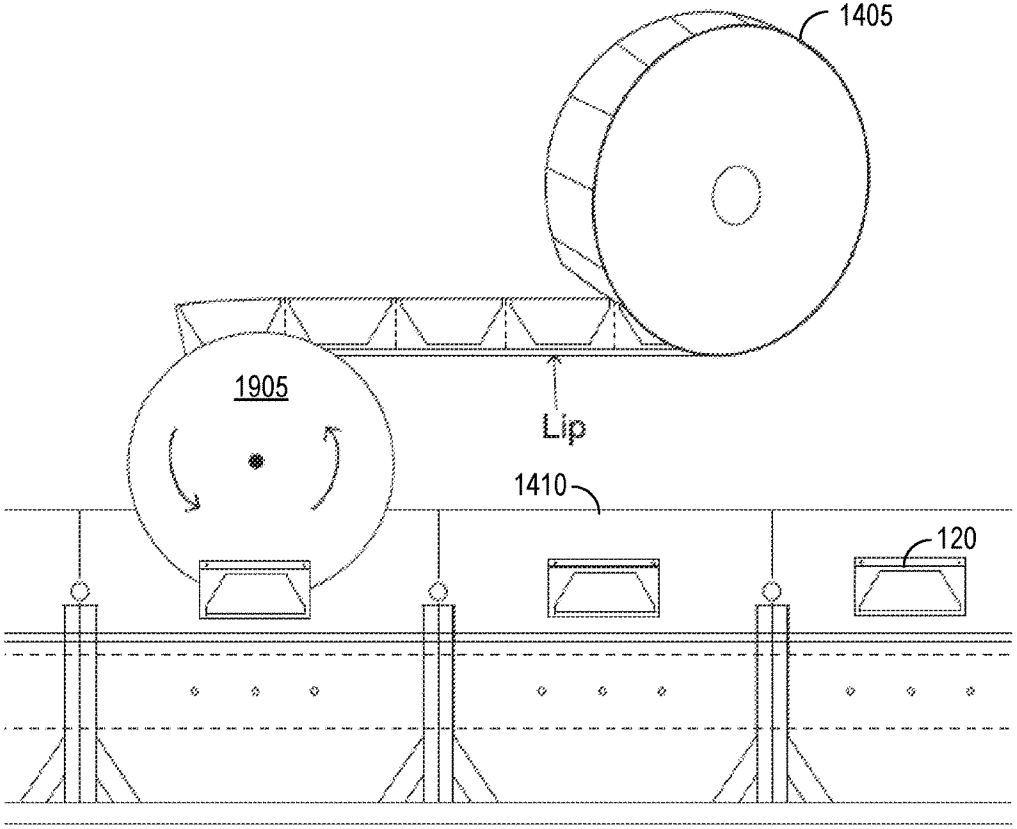
FIG. 20 is a view 2000 showing additional detail of the rotary inserter machine of FIG. 19 in accordance with one embodiment.

FIG. 20 is a view 2000 showing additional detail of the rotary inserter machine of FIG. 19 in accordance with another embodiment.

Figure 21A:
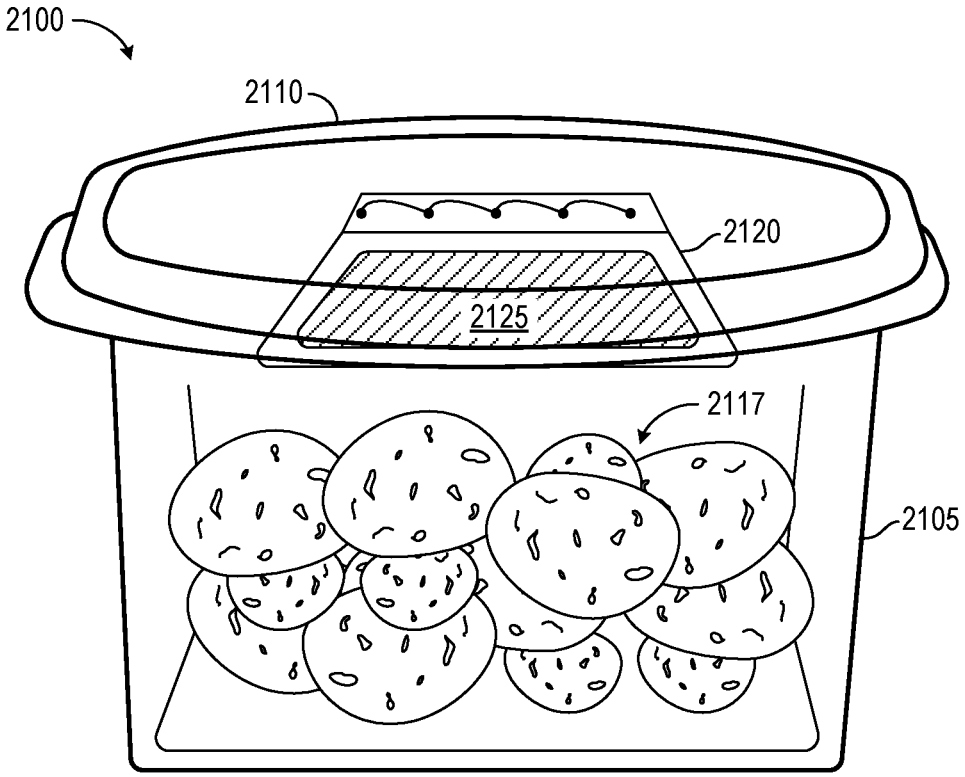
FIG. 21A depicts a view of a plastic food package 2100 with a tray 2105 and lid 2110, the latter of which is manufactured separately but can be made integral with tray 2105 in other embodiments.

FIG. 21A depicts a view of a plastic food package 2100 with a tray 2105 and lid 2110, the latter of which is manufactured separately but can be integral with tray 2105 in e.g. a clamshell configuration in other embodiments. A sidewall 2115 defines a package interior that in this example includes raw or partially cooked potatoes 2117. A thermally breachable packet 2120, containing a liquid 2125 is attached to the undersides of lid 2110 via a tab 2130. Packet 2120 exhibits a breach threshold that causes it to burst at a time appropriate to bathe potatoes 2117 in liquid before the potatoes are fully cooked. In this example, both tray 2105 and lid 2110 are of a clear, FDA-approved plastic. As with the stand-up pouches of prior examples, food package 2100 can support myriad combinations of foods and sauces.

Figure 21B:
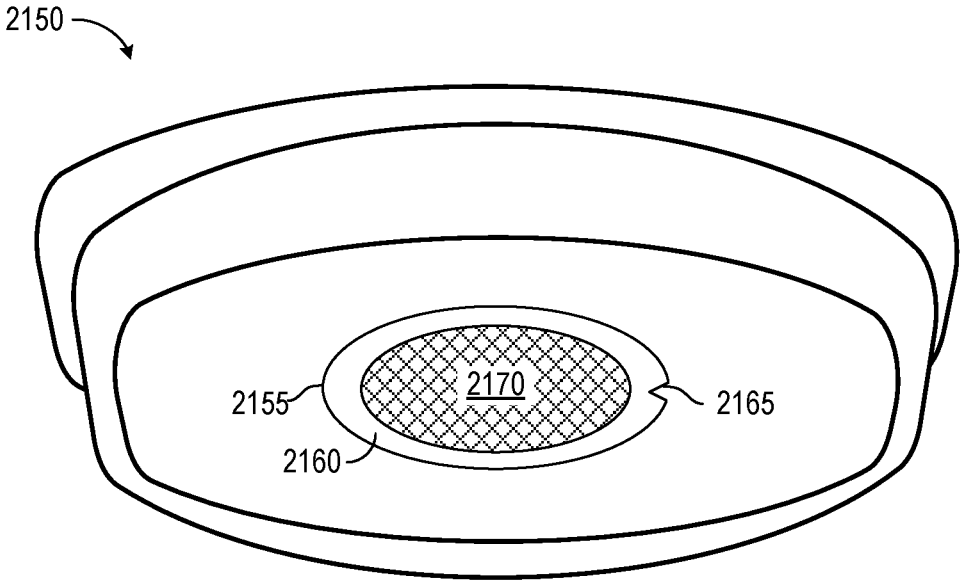
FIG. 21B depicts a plastic food-package lid 2150 with an integrated sauce packet 2155.

FIG. 21B depicts a plastic food-package lid 2150 with an integrated sauce packet 2155. Sauce packet 2150 is a single sheet in which a weld 2160 with stress concentrator 2165 traps a liquid 2170 against the underside of lid 2150. During heating, weld 2160 delaminates at stress concentrator 2165 to dispense liquid 2170 on underlying food (not shown).

Figure 22:
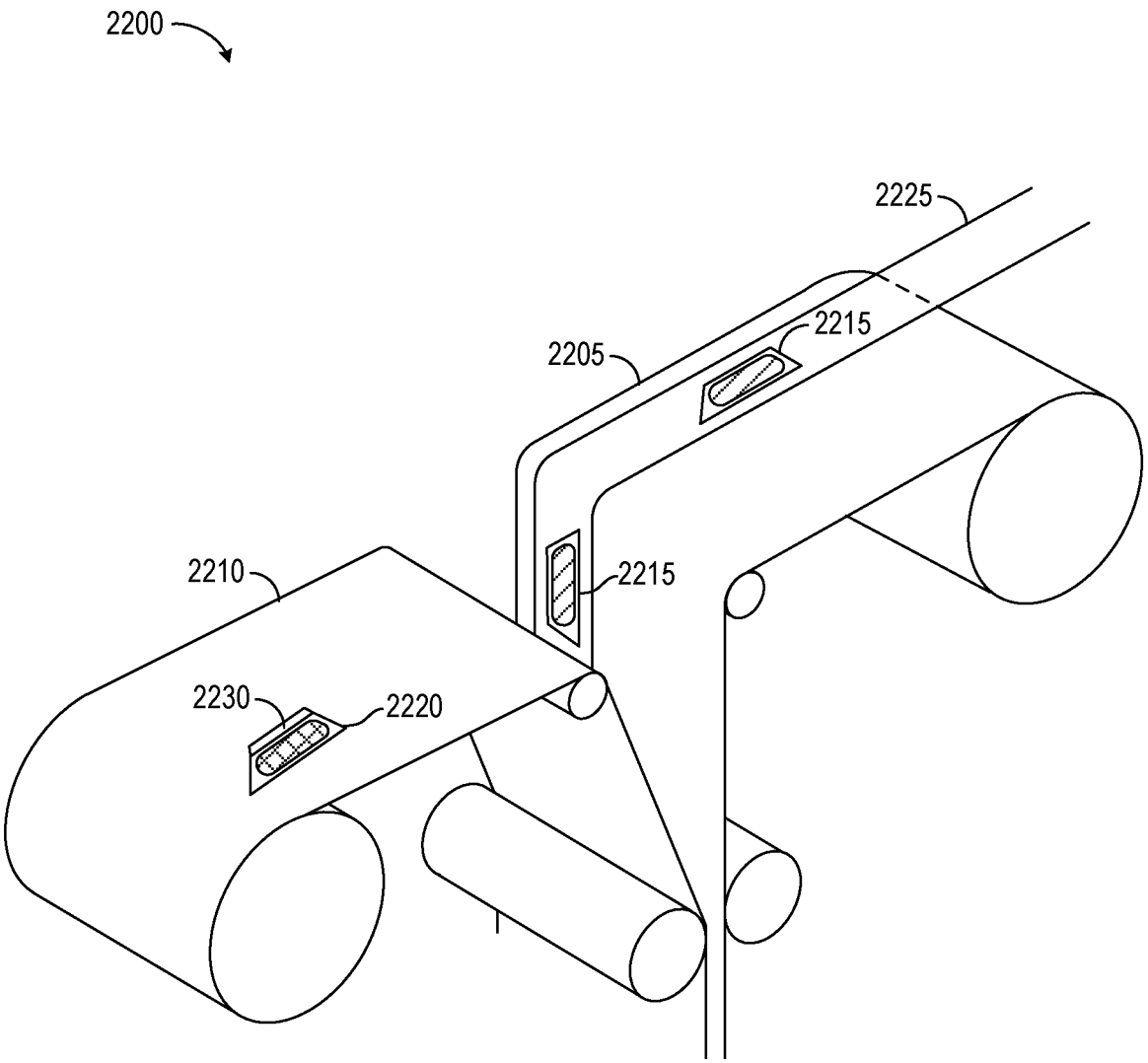
FIG. 22 depicts an input mechanism for a vertical pouch machine 2200 that assembles pouches (not shown) by joining a pair of sheets 2205 and 2210 in a "dual-web unwind" process.

FIG. 22 depicts an input mechanism for a vertical pouch machine 2200 that assembles pouches (not shown) by joining a pair of sheets 2205 and 2210 in a "dual-web unwind" process. Burstable packets 2215 are provided as rollstock 2225 that is automatically welded in place as pouches (not shown) are separated and their boundaries welded. In addition or as an alternative, packets 2220 can be periodically welded to sheet 2210 on what will become the interior surfaces of a series of pouches. Packets 2220 are welded in place via a tab 2230 in the manner noted previously. As between the two methods of packet insertion, a continuous strip of packets 2215 fed into the formed or forming packaging material to be sealed and cut together may be simpler for e.g. high-speed packaging. Space permitting, multiple packets per pouch can be formed and placed using a single strip.

This embodiment illustrates that multiple packets 2215 and 2220 can be provided per container, a feature that can be employed for e.g. separately sourced or incompatible fluids. Packets 2215 and 2220 can be of the same or different constructions, and can be formulated to breach at the same or different times. Though not shown, a pouch machine in accordance with another embodiment forms pouches using a single sheet folded on e.g. a horizontal form fill-and-seal machine. In still other embodiments burstable packets can be incorporated into one or both sheets as "blisters" that trap the liquid against the sheet rather than as pre-formed packets later connected to the sheets.

Figure 23:
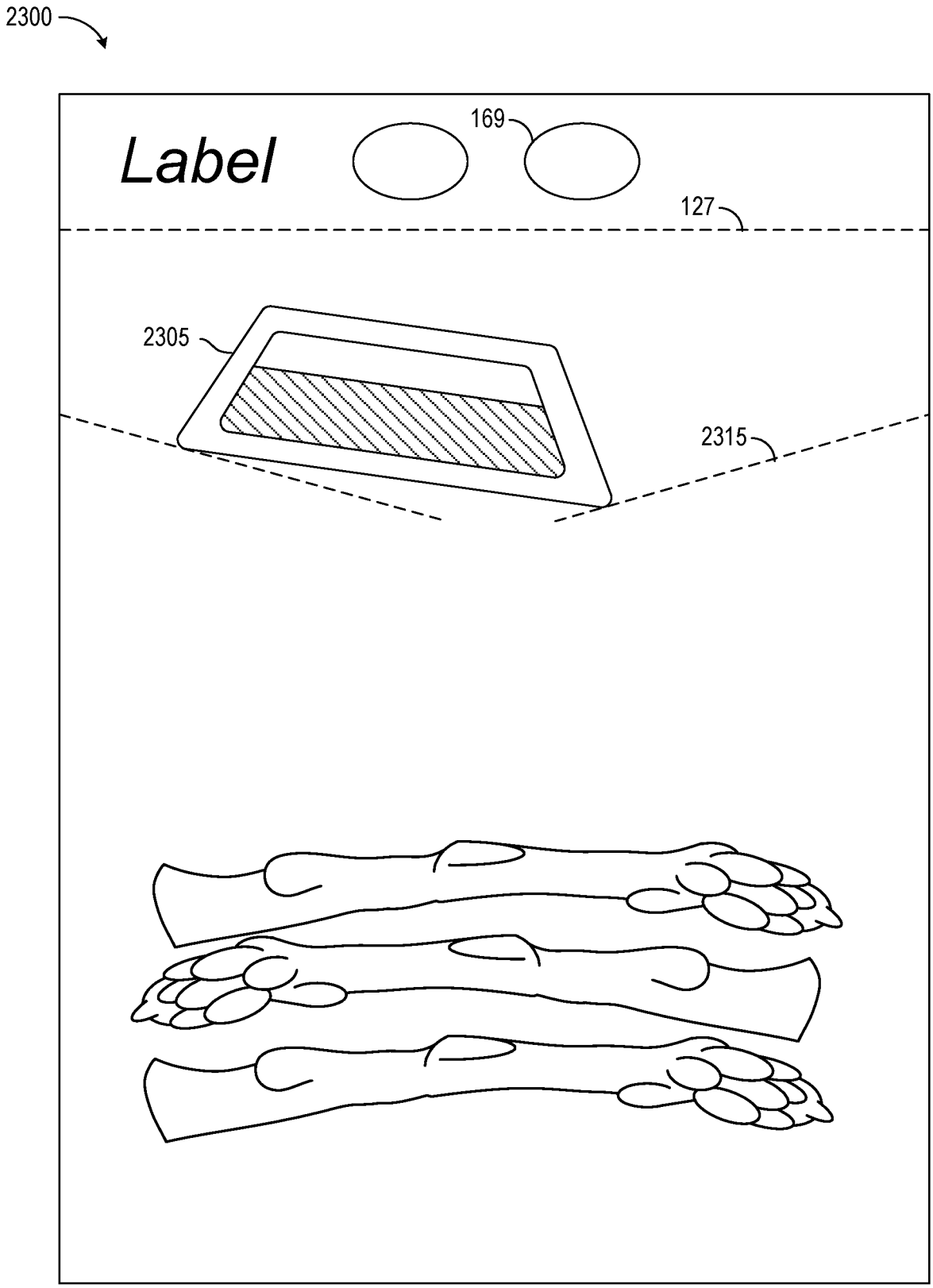
FIG. 23 depicts a stand-up pouch 2300 in which a sauce packet 2305 is included without physical attachment to the pouch.

FIG. 23 depicts a stand-up pouch 2300 similar to pouch 101 of FIG. 1, with like-identified elements being the same or similar. In this example a sauce packet 2305 is included without physical attachment to the pouch. Packet 2305 can be separated from food 2310 using a partial or perforated seal 2315, can be inserted into a pocket (not shown) in the pouch sidewall, or can be loosely included with the food.

Variations of these embodiments, and variations in usage of these embodiments, including separate or combined embodiments in which features are used separately or in any combination, will be obvious to those of ordinary skill in the art. Therefore, the spirit and scope of the appended claims should not be limited to the foregoing description. In U.S. applications, only those claims specifically reciting "means for" or "step for" should be construed in the manner required under 35 U.S.C. § 112(f).

What is claimed is:

1. A disposable container for heating food, the disposable container in a form of a stand-up pouch comprising:

parallel container sidewalls coming together to form a container top, a container bottom, the container sidewalls and the container bottom defining a pouch interior, the pouch interior including a food region between the container top and the container bottom; and a thermally breachable packet within the pouch interior, the thermally breachable packet having a packet top attached to one of the sidewalls, a packet bottom facing the food region and the container bottom, a packet interior containing a liquid, and a seal encompassing the liquid, the seal having a longest side facing the container bottom;

the packet having a packet top connected to one of the container sidewalls, the packet bottom disconnected from the one of the container sidewalls and free to move away from the one of the container sidewalls; and the longest side of the seal directing pressure of the liquid to burst the longest side of the seal toward the food region.

2. The disposable container of claim 1, the packet including a laminate of a peelable inner packet layer in contact with the liquid and an outer packet layer.

3. The disposable container of claim 2, the inner packet layer forming a breachable bottom seal having a reduced contact area.

4. The disposable container of claim 2, the inner packet layer forming a breachable bottom seal having a total seal area encompassing a pattern of sealed area defining an unsealed area, wherein the sealed area is continuous along a dimension of the seal.

5. The disposable container of claim 1, the packet including a laminate of at least two polymers, the laminate including a peelable inner layer encompassing the liquid.

6. The disposable container of claim 1, the packet having a predetermined breach threshold responsive to the pressure.

7. The disposable container of claim 1, wherein the liquid is an emulsion.

8. The disposable container of claim 7, the emulsion comprised of a 90/10 ratio of butter and water, the food region containing food.

9. The disposable container of claim 1, the disposable container further comprising information specifying a heating interval and a power level, the thermally breachable packet to breach within a fraction of the heating interval.

10. The disposable container of claim 9, the food region containing the food, the thermally breachable packet breaching within a fraction of the heating interval and releasing the liquid onto the food.

11. The disposable container of claim 1, the packet comprising at least two olefin polymers and a peelable seal having a cohesive strength less than a fusion weld.

12. The disposable container of claim 11, the container sidewall having an inner pouch surface of a type comprising at least one of the two olefin polymers, the inner pouch surface connected to the thermally breachable packet.

13. A stand-up pouch comprising:

parallel sidewalls coming together to form a container top;

a container bottom between the sidewalls and opposite the container top, the container sidewalls and the container bottom defining a pouch interior; and a thermally breachable packet within the pouch interior, the thermally breachable packet having a top edge attached to at least one of the parallel sidewalls and a bottom edge detached from the sidewalls, the bottom edge facing the container bottom the packet including a laminate of at least two polymers, the laminate including an inner layer forming a seal encapsulating a sauce, the seal including a breachable longest side along the bottom edge of the packet.

14. The stand-up pouch of claim 13, wherein the seal encapsulating the sauce is a polygon.

15. The stand-up pouch of claim 14, the seal having at least four sides, including the longest side.

16. The stand-up pouch of claim 13, wherein the inner layer of the packet is fused to the at least one of the parallel sidewalls.

* * * * *